US009666066B2

(12) United States Patent
Hiramatsu et al.

(10) Patent No.: US 9,666,066 B2
(45) **Date of Patent: *May 30, 2017**

(54) UNEXPECTEDNESS PREDICTION SENSITIVITY DETERMINATION APPARATUS

(71) Applicant: NISSAN MOTOR CO., LTD., Kanagawa (JP)

(72) Inventors: Machiko Hiramatsu, Yokosuka (JP); Takashi Sunda, Sagamihara (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 76 days.

This patent is subject to a terminal disclaimer.

(21) Appl. No.: 14/384,500

(22) PCT Filed: Mar. 12, 2013

(86) PCT No.: PCT/JP2013/001626

§ 371 (c)(1),
(2) Date: Sep. 11, 2014

(87) PCT Pub. No.: WO2013/136779

PCT Pub. Date: Sep. 19, 2013

(65) Prior Publication Data

US 2015/0057914 A1 Feb. 26, 2015

(30) Foreign Application Priority Data

Mar. 16, 2012 (JP) ..... 2012-060433

(51) Int. Cl.
*G08G 1/01* (2006.01)
*G08G 1/16* (2006.01)

(52) U.S. Cl.
CPC ..... *G08G 1/0112* (2013.01); *G08G 1/0129* (2013.01); *G08G 1/163* (2013.01); *G08G 1/164* (2013.01)

(58) Field of Classification Search
CPC .... G08G 1/0112; G08G 1/0129; G08G 1/163; G08G 1/164; G08G 1/165; G08G 1/166
(Continued)

(56) References Cited

U.S. PATENT DOCUMENTS

2007/0027583 A1 2/2007 Tamir et al.
2009/0082917 A1 3/2009 Adachi
(Continued)

FOREIGN PATENT DOCUMENTS

JP 3882541 B2 2/2007
JP 2013-095291 A 5/2013

OTHER PUBLICATIONS

U.S. Patent Application No. Unknown, filed herewith with the title Unexpectedness Prediction Sensitivity Determination Apparatus and inventors Machiko Hiramatsu et al.

*Primary Examiner* — Redhwan K Mawari
*Assistant Examiner* — Anshul Sood
(74) *Attorney, Agent, or Firm* — Young Basile Hanlon & MacFarlane, P.C.

(57) ABSTRACT

An unexpectedness prediction sensitivity determining apparatus determines a standard driving operation level of a driver when turning to the right or left at an intersection for each intersection based on intersection travel information received from plural vehicles. Subsequently, the unexpectedness prediction sensitivity determining apparatus determines the unexpectedness prediction sensitivity of the driver when turning to the right or left at the intersection based on the intersection travel information associated with the intersections where determined standard driving operation levels of the drivers are identical to one another.

13 Claims, 11 Drawing Sheets

(58) Field of Classification Search
USPC ..... 701/117
See application file for complete search history.

(56) References Cited

U.S. PATENT DOCUMENTS

| | | | | |
|---|---|---|---|---|
| 2010/0049429 | A1 | 2/2010 | Lee | |
| 2015/0042463 | A1* | 2/2015 | Hiramatsu ..... | G08G 1/0112<br>340/439 |

* cited by examiner

| INTERSECTION PASSAGE CHARACTERISTIC VALUE AVERAGE ($\gamma_{maxAve}$ (deg/s)) | STANDARD DRIVING OPERATION LEVEL OF DRIVER WHEN TURNING TO THE RIGHT OR LEFT AT INTERSECTION |
|---|---|
| 0 ~ 20 | LOW |
| 20 ~ | HIGH |

| INTERSECTION PASSAGE CHARACTERISTIC VALUE AVERAGE ($V_{\gamma maxAve}$ (km/h)) | STANDARD DRIVING OPERATION LEVEL OF DRIVER WHEN TURNING TO THE RIGHT OR LEFT AT INTERSECTION |
|---|---|
| 0 ~ 30 | HIGH |
| 30 ~ | LOW |

| INTERSECTION PASSAGE CHARACTERISTIC VALUE STANDARD DEVIATION ($\gamma_{max\sigma}$ (deg/s)) | STANDARD DRIVING OPERATION LEVEL OF DRIVER WHEN TURNING TO THE RIGHT OR LEFT AT INTERSECTION |
|---|---|
| $0 \sim \gamma_1$ | LOW |
| $\gamma_1 \sim \gamma_2$ | INTERMEDIATE |
| $\gamma_2 \sim$ | HIGH |

| INTERSECTION PASSAGE CHARACTERISTIC VALUE STANDARD DEVIATION ($V_{\gamma max\sigma}$ (km/h)) | STANDARD DRIVING OPERATION LEVEL OF DRIVER WHEN TURNING TO THE RIGHT OR LEFT AT INTERSECTION |
|---|---|
| $0 \sim V_1$ | LOW |
| $V_1 \sim V_2$ | INTERMEDIATE |
| $V_2 \sim$ | HIGH |

UNEXPECTEDNESS PREDICTION SENSITIVITY DETERMINATION APPARATUS

CROSS-REFERENCE TO RELATED APPLICATION

This application claims priority from Japanese Patent Application No. 2012-60433, filed Mar. 16, 2012, which is incorporated herein in its entirety by reference.

TECHNICAL FIELD

The present invention relates to an unexpectedness prediction sensitivity determination apparatus.

BACKGROUND

As an unexpectedness prediction sensitivity determination apparatus, for example, there is a related art technique disclosed in Japanese Patent No. 3882541.

In this related art technique, a vehicle collects vehicle velocity information. Subsequently, the vehicle transmits the collected vehicle velocity information to a base station. Subsequently, the base station records the received vehicle velocity information. Subsequently, the base station determines an unexpectedness prediction sensitivity of a driver based on the entire recorded vehicle velocity information. The unexpectedness prediction sensitivity refers to an index indicating a degree of capacity of predicting unexpected situations in which the vehicle approaches an obstacle such as another vehicle or a pedestrian (caused since the vehicle approaches an oncoming vehicle that travels straight on the opposite lane when the vehicle turns to the right or left at an intersection, caused since the vehicle approaches a motorcycle that travels on the left side when the vehicle turns to the left at an intersection, caused since the vehicle approaches a pedestrian when the vehicle turns to the right or left at an intersection, or the like), for example.

BRIEF SUMMARY

However, in the Japanese Patent No. 3882541, the unexpectedness prediction sensitivity of the driver is determined simply based on the entire recorded vehicle velocity information. Thus, for example, when a driving operation of the driver is changed for each intersection according to visibility, a traffic volume or the like of an intersection, and thus the vehicle velocity when turning to the right or left at the intersection varies, there is a possibility that determination accuracy of the unexpectedness prediction sensitivity of the driver when turning to the right or left at the intersection deteriorates.

The invention is made in order to solve the above problem, and an object thereof is to improve determination accuracy of an unexpectedness prediction sensitivity of a driver when turning to the right or left at an intersection.

According to an aspect of the invention, for example, a standard driving operation level of a driver when turning to the right or left at an intersection is determined for each intersection based on intersection travel information received from plural vehicles. Subsequently, in this aspect of the invention, the unexpectedness prediction sensitivity of the driver when turning to the right or left at the intersection is determined based on the intersection travel information associated with the intersections where determined standard driving operation levels of the drivers are identical to one another.

DETAILED DESCRIPTION

Hereinafter, embodiments of the invention will now be described with reference to the drawings.

In the present embodiments, the invention is applied to an unexpectedness prediction sensitivity determination system S.

(Configuration)

Figure 1:
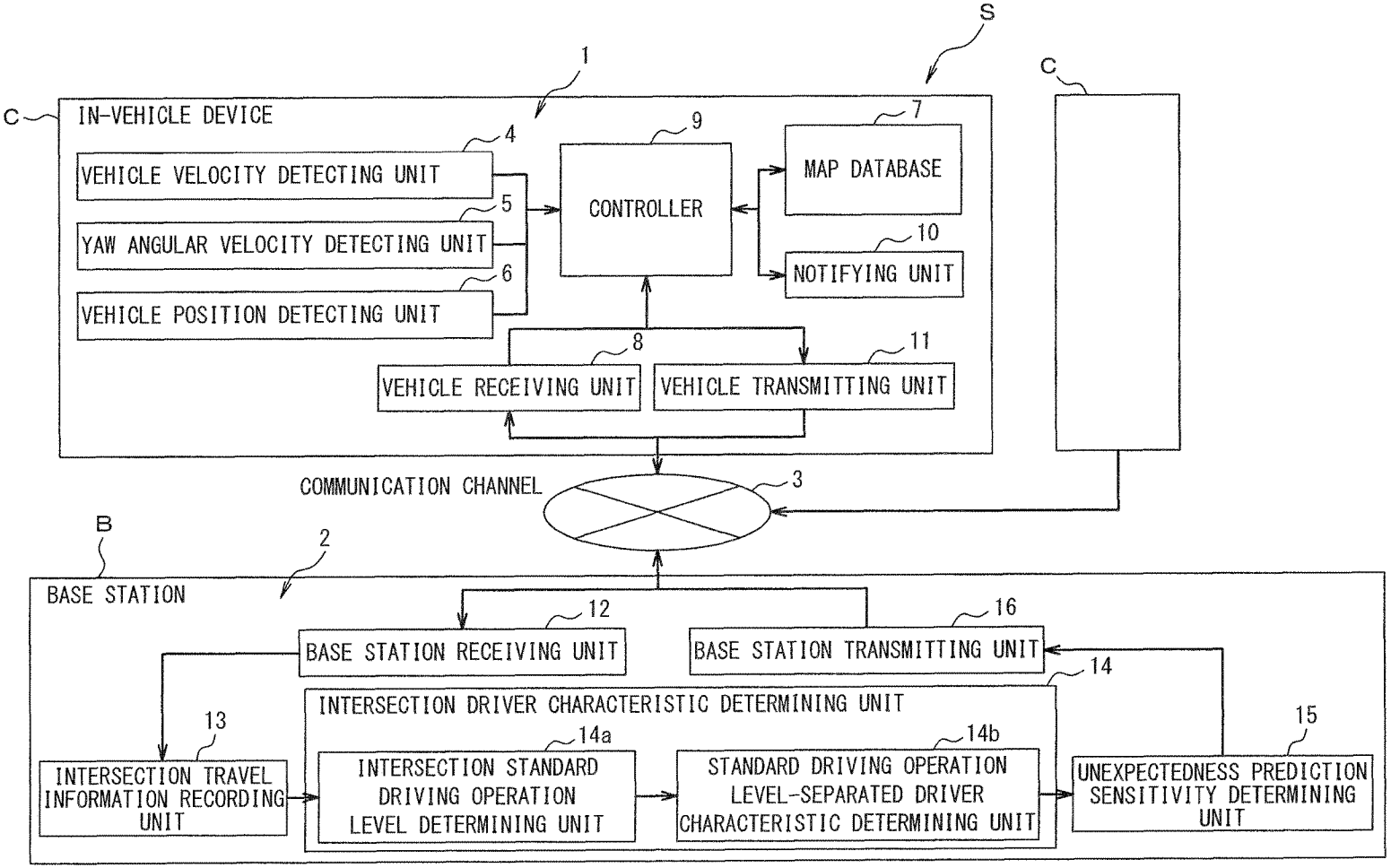
FIG. 1 is a diagram illustrating a schematic configuration of an unexpectedness prediction sensitivity determination system S.

FIG. 1 is a diagram schematically illustrating a configuration of an unexpectedness prediction sensitivity determination system S.

As shown in FIG. 1, the unexpectedness prediction sensitivity determination system S includes an in-vehicle device 1 that is mounted in each of plural vehicles C and an unexpectedness prediction sensitivity determination apparatus 2 provided in a base station B. The in-vehicle device 1 and the unexpectedness prediction sensitivity determination apparatus 2 transmit and receive information through a communication channel 3.

(Configuration of In-Vehicle Device 1)

The in-vehicle device 1 includes a vehicle velocity detecting unit 4, a yaw angular velocity detecting unit 5, a vehicle position detecting unit 6, a map database 7, a vehicle receiving unit 8, a controller 9, a notifying unit 10 and a vehicle transmitting unit 11.

The vehicle velocity detecting unit 4 detects a current vehicle velocity V of the vehicle C. Further, the vehicle velocity detecting unit 4 outputs information indicating the detected current vehicle velocity V to the controller 9. As the vehicle velocity detecting unit 4, for example, a vehicle velocity sensor that detects a vehicle velocity V based on a rotational speed of a wheel of the vehicle C is employed.

The yaw angular velocity detecting unit 5 detects a current yaw angular velocity γ of the vehicle C. Further, the yaw angular velocity detecting unit 5 outputs information indicating the detected current yaw angular velocity γ to the controller 9. As the yaw angular velocity detecting unit 5, for example, a yaw angular velocity sensor is employed.

The vehicle position detecting unit 6 detects a current position of the vehicle C. Further, the vehicle position detecting unit 6 outputs information indicating the detected current position to the controller 9. As the vehicle position detecting unit 6, for example, a global positioning system (GPS) receiver is employed.

The map database 7 records therein map information about an area where the vehicle C is traveling. The map information includes information about the position, shape, type and the like of a road or an intersection. Here, the intersection includes an intersection where a traffic signal is present and an intersection where the traffic signal is not present.

The vehicle receiving unit 8 receives information transmitted by the unexpectedness prediction sensitivity determination apparatus 2 through the communication channel 3. Further, the vehicle receiving unit 8 outputs the received information to the controller 9.

Figure 2A:
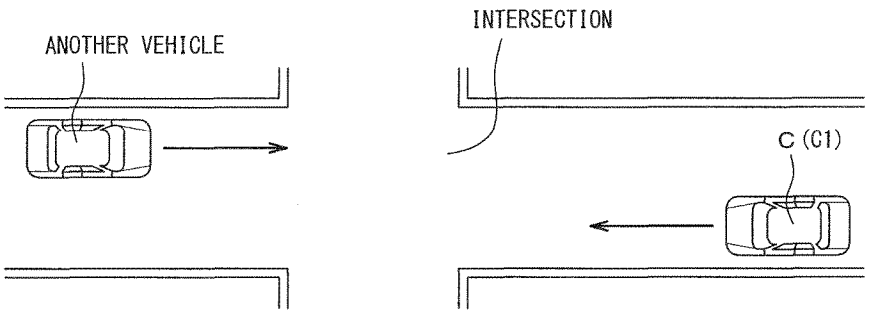
FIGS. 2A to 2C are diagrams illustrating an intersection passage characteristic value.
Figure 2B:
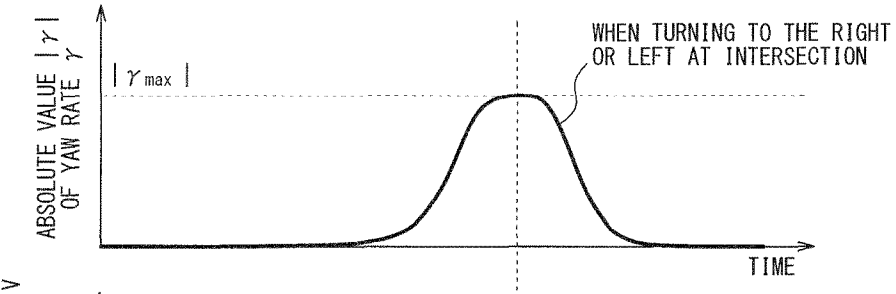
Figure 2C:
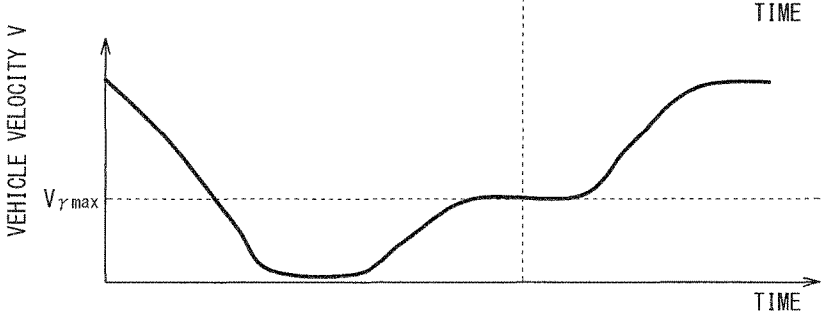

FIGS. 2A to 2C are diagrams illustrating an intersection passage characteristic value.

The controller 9 executes an intersection travel information transmission process based on the information output by the vehicle velocity detecting unit 4, the yaw angular velocity detecting unit 5 and the vehicle position detecting unit 6 and the map information recorded in the map database 7. In the intersection travel information transmission process, the controller 9 generates intersection travel information every time the vehicle C turns to the right or left at the intersection. The intersection travel information refers to data that includes an intersection passage characteristic value when turning to the right or left at the intersection, an intersection ID of the intersection where the corresponding intersection passage characteristic value is obtained and a vehicle ID of the vehicle C. The intersection ID refers to unique information set for each intersection, which may uniquely specify the intersection. For example, as the intersection ID, a numerical number of 1 to n (where n is the total number of intersections registered in map data) may be employed. The vehicle ID refers to unique information set for each vehicle C mounted with the in-vehicle device 1, which may uniquely specify the vehicle C. As the vehicle ID, for example, a numerical number of 1 to m (where m is the total number of vehicles C mounted with the in-vehicle device 1) may be employed. Thus, the intersection and the vehicle C are associated with the intersection travel information. The intersection passage characteristic value refers to a travel state amount indicating a travel state of the vehicle C when turning to the right or left at the intersection, which is an index value indicating a standard driving operation level of a driver when turning to the right or left at the intersection (to be described later) and an unexpectedness prediction sensitivity of the driver. In the present embodiment, as shown in FIGS. 2A to 2C, as the intersection passage characteristic value, a maximum value of the yaw angular velocity γ when turning to the right or left at the intersection (hereinafter, also referred to as a maximum yaw angular velocity γmax) and a vehicle velocity when the yaw angular velocity γ reaches the maximum value when turning to the right or left at the intersection (hereinafter, also referred to as a yaw angular velocity maximum vehicle velocity Vγmax) are employed. Then, the controller 9 transmits the generated intersection travel information to the unexpectedness prediction sensitivity determination apparatus 2 through the vehicle transmitting unit 11.

In the present embodiment, an example in which the maximum yaw angular velocity γmax and the yaw angular velocity maximum vehicle velocity Vγmax are used as the intersection travel information is shown, but a different configuration may be employed. For example, a maximum transverse acceleration when turning to the right or left at the intersection may be employed instead of the maximum yaw angular velocity γmax.

Further, for example, a transverse acceleration maximum vehicle velocity that is a vehicle velocity when a transverse acceleration reaches the maximum value when turning to the right or left at the intersection may be employed instead of the yaw angular velocity maximum vehicle velocity Vγmax.

Further, the controller 9 outputs a notification command for notifying the determination result of the unexpectedness prediction sensitivity of the driver of the vehicle C based on the information output by the vehicle receiving unit 8, to the notifying unit 10.

The notifying unit 10 notifies the determination result of the unexpectedness prediction sensitivity of the driver of the vehicle C based on the notification command output by the controller 9. As the notifying unit 10, for example, a monitor or a speaker is employed.

The vehicle transmitting unit 11 transmits the intersection travel information generated by the controller 9 to the unexpectedness prediction sensitivity determination apparatus 2 through the communication channel 3.

(Configuration of Unexpectedness Prediction Sensitivity Determination Apparatus 2)

The unexpectedness prediction sensitivity determination apparatus 2 includes a base station receiving unit 12, an intersection travel information recording unit 13, an intersection driver characteristic determining unit 14, an unexpectedness prediction sensitivity determining unit 15, and a base station transmitting unit 16.

The base station receiving unit 12 receives the intersection travel information transmitted by the vehicle transmitting unit 11 through the communication channel 3. Further, the base station receiving unit 12 outputs the received intersection travel information to the intersection travel information recording unit 13.

The intersection travel information recording unit 13 records therein the intersection travel information about the plural vehicles C based on the intersection travel information received by the base station receiving unit 12. As the intersection travel information recording unit 13, for example, a hard disk drive (HDD) or a random access memory (RAM) is employed.

The intersection driver characteristic determining unit 14 includes an intersection standard driving operation level determining unit 14*a* and a standard driving operation level-separated driver characteristic determining unit 14*b*.

The intersection standard driving operation level determining unit 14*a* calculates an average value γmaxAve (hereinafter, also referred to as an intersection passage characteristic value average) of an absolute value of the intersection passage characteristic value γmax for each intersection based on the intersection travel information received from the plural vehicles C, among the intersection travel information recorded in the intersection travel information recording unit 13. As the intersection travel information received from the plural vehicles C, for example, the intersection travel information received from all the vehicles C that turn to the right or left at the target intersection is employed. Subsequently, the intersection standard driving operation level determining unit 14*a* determines the standard driving operation level of the driver when turning to the right or left at the intersection for each intersection based on the calculated intersection passage characteristic value average γmaxAve. As the standard driving operation level of the driver when turning to the right or left at the intersection, for example, an index of the level of a driving operation of a standard driver when turning to the right or left at the intersection is used. In the present embodiment, it is determined which one of predetermined plural stages the standard driving operation level of the driver is at. As the predetermined plural stages, for example, two stages of "high" and "low" are employed.

The standard driving operation level-separated driver characteristic determining unit 14*b* selects the intersection travel information associated with the intersections where the standard driving operation levels of the drivers determined by the intersection standard driving operation level determining unit 14*a* are identical to one another, among the intersection travel information recorded in the intersection travel information recording unit 13. In the present embodiment, among the intersections where the standard driving operation levels of the drivers are identical to one another, the intersection travel information associated with the intersections where the standard driving operation level of the driver is at the highest stage "high" is employed. Subsequently, the standard driving operation level-separated driver characteristic determining unit 14*b* calculates an average value (hereinafter, also referred to as a vehicle-separated intersection passage characteristic value average) VγmaxCAve of the intersection passage characteristic value Vγmax for each vehicle C based on the selected intersection travel information. In the present embodiment, an example in which the intersection standard driving operation level determining unit 14*a* employs the intersection travel information associated with the intersections where the standard driving operation level of the driver is at the highest stage "high" is shown, but a different configuration may be employed. For example, the intersection travel information associated with the intersections where the standard driving operation level of the driver is at the stage "low" may be employed.

The unexpectedness prediction sensitivity determining unit 15 determines the unexpectedness prediction sensitivity of the driver when turning to the right or left at the intersection for each vehicle C based on the vehicle-separated intersection passage characteristic value average VγmaxCAve calculated by the standard driving operation level-separated driver characteristic determining unit 14*b*. The unexpectedness prediction sensitivity of the driver when turning to the right or left at the intersection refers to an index value indicating a possibility that the vehicle is approaching another vehicle or a pedestrian when turning to the right or left at the intersection. In the present embodiment, it is determined which one of the predetermined plural stages the unexpectedness prediction sensitivity is at. As the predetermined plural stages, for example, three stages of "high", "intermediate" and "low" are employed.

The base station transmitting unit 16 transmits the unexpectedness prediction sensitivity of the driver determined by the unexpectedness prediction sensitivity determining unit 15 to the vehicle receiving unit 8 provided in each of the plural vehicles C through the communication channel 3.

(Computing Process)

Next, an intersection travel information transmission process executed by the controller 9 will be described.

Figure 3:
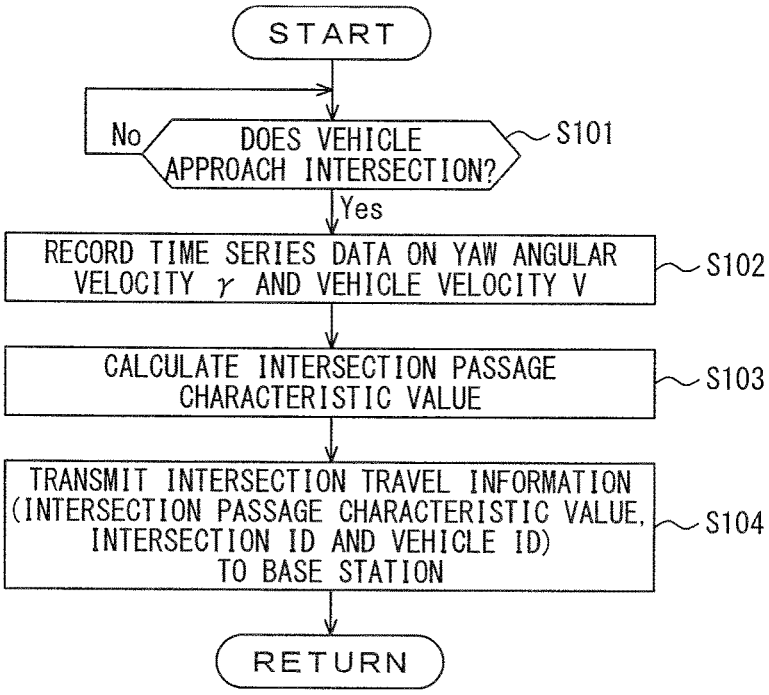
FIG. 3 is a flowchart illustrating an intersection travel information transmission process.

FIG. 3 is a flowchart illustrating the intersection travel information transmission process.

As shown in FIG. 3, in step S101, the controller 9 determines whether or not the vehicle C approaches the intersection based on the current position of the vehicle C detected by the vehicle position detecting unit 6 and the map data recorded in the map database 7. Specifically, the controller 9 determines whether or not the vehicle C is within a predetermined set range of the intersection (for example, within a range of a radius of 30 m from the center of the intersection). Then, if it is determined that the vehicle C is within the set range of the intersection (Yes), the controller 9 determines that the vehicle C approaches the intersection, and the procedure proceeds to step S102. On the other hand, if it is determined that the vehicle C is out of the set range of the intersection (No), the controller 9 determines that the vehicle C does not approach the intersection, and the determination in step S101 is executed again.

In step S102, the controller 9 records time series data on the yaw angular velocity γ and time series data on the vehicle velocity V when turning to the right or left at the intersection (hereinafter, also referred to as a target intersection) that is determined as being approached by the vehicle C in step S101. Specifically, first, the controller 9 starts the recording of the time series data on the yaw angular velocity γ and the time series data on the vehicle velocity V. A sampling time of the time series data is set to 10 ms, for example. Subsequently, the controller 9 determines whether or not the vehicle C turns to the right or left at the target intersection based on the current position of the vehicle C detected by the vehicle position detecting unit 6 and the map data stored in the map database 7. Specifically, the controller 9 determines whether or not a road that the vehicle C travels after passage of the target intersection (that is, after getting out of the set range) is a road (hereinafter, referred to as an intersection road) that intersects with a road that the vehicle C has traveled before passage of the target intersection. Further, if it is determined that the road that the vehicle C travels after passage of the target intersection is the intersection road (Yes), the controller 9 determines that the vehicle C turns to the right or left at the target intersection, and the procedure proceeds to step S106. On the other hand, if it is determined that the road that the vehicle C travels after passage of the target intersection is not the intersection road (No), the controller 9 determines that the vehicle C does not turn to the right or left at the target intersection, and the procedure returns to step S101. If the procedure returns to step S101, the controller 9 deletes the recorded time series data on the yaw angular velocity γ and the vehicle velocity V.

In step S103, the controller 9 calculates the intersection passage characteristic values (maximum yaw angular velocity and yaw angular velocity maximum vehicle velocity) γmax and Vγmax based on the time series data on the yaw angular velocity γ and the time series data on the vehicle velocity V recorded in step S102. Specifically, the controller 9 sets the vehicle velocity V when the yaw angular velocity γ reaches the maximum value γmax when turning to the right or left at the intersection as the yaw angular velocity maximum vehicle velocity Vγmax based on the time series data on the yaw angular velocity γ and the time series data on the vehicle velocity V. Subsequently, the controller 9 generates intersection travel information including the calculated intersection passage characteristic values γmax and Vγmax, an intersection ID of the target intersection and a vehicle ID of the vehicle C.

Subsequently, the procedure proceeds to step S104, and then, the controller 9 transmits the intersection travel information generated in step S103 to the base station B through the vehicle transmitting unit 11.

Next, an unexpectedness prediction sensitivity determination process executed by the unexpectedness prediction sensitivity determination apparatus 2 (the base receiving unit 12, the intersection travel information recording unit 13, the intersection driver characteristic determining unit 14, the unexpectedness prediction sensitivity determining unit 15 and the base station transmitting unit 16) will be described.

Figure 4:
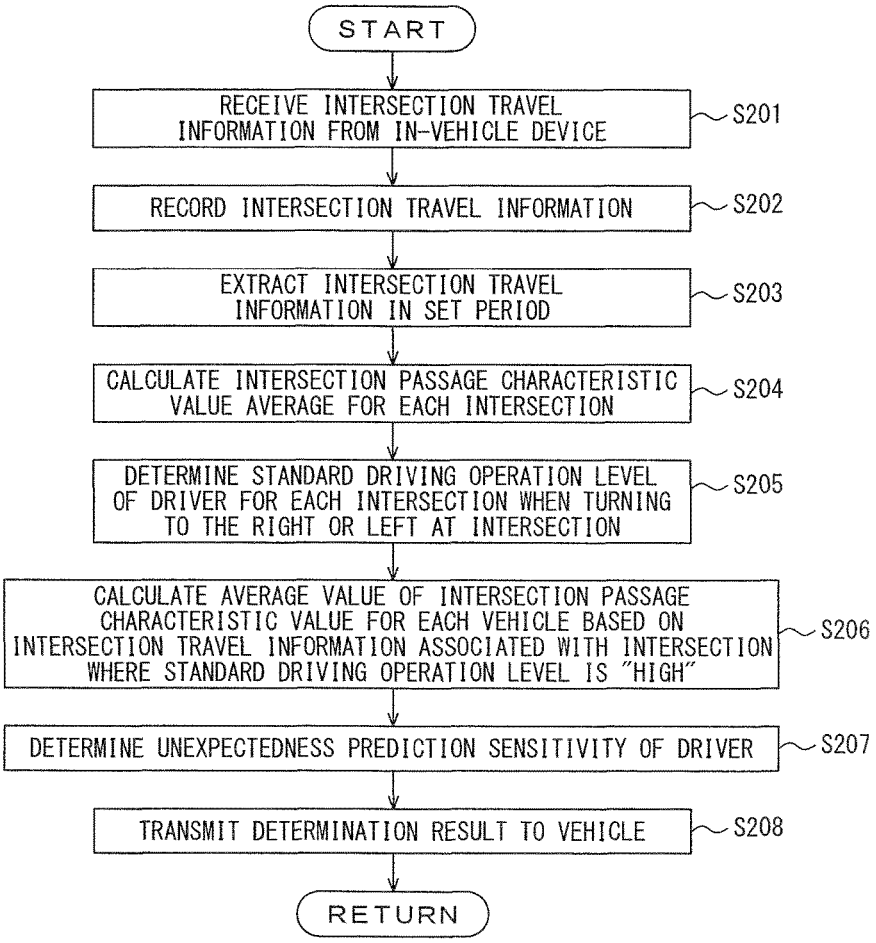
FIG. 4 is a flowchart illustrating an unexpectedness prediction sensitivity determination process.

FIG. 4 is a flowchart illustrating the unexpectedness prediction sensitivity determination process.

As shown in FIG. 4, in step S201, the base station receiving unit 12 receives the intersection travel information (the data including the intersection passage characteristic value, the intersection ID of the target intersection and the vehicle ID of the vehicle C) transmitted by the in-vehicle device 1.

Subsequently, the procedure proceeds to step S202, and then, the intersection travel information recording unit 13 records the intersection travel information received in step S201. Thus, the intersection travel information recording unit 13 records the intersection travel information of the plural vehicles C at plural intersections.

Subsequently, the procedure proceeds to step S203, and then, the intersection standard driving operation level determining unit 14*a* extracts the intersection travel information recorded in a predetermined set period (for example, a period of 30 days prior to the current date) from among the intersection travel information recorded in the intersection travel information recording unit 13.

Figure 5:
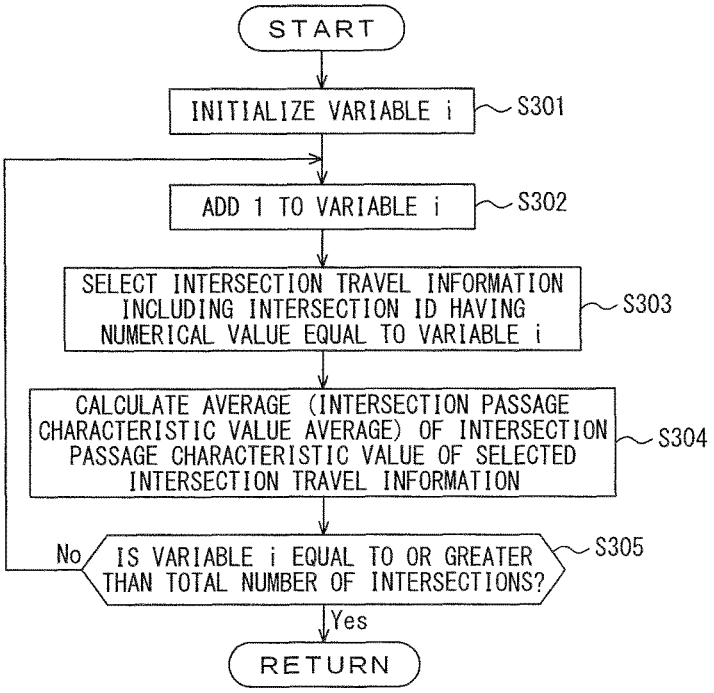
FIG. 5 is a flowchart illustrating details of a process executed in step S204.

FIG. 5 is a flowchart illustrating details of the process executed in step S204.

Subsequently, the procedure proceeds to step S204, and then, the intersection standard driving operation level determining unit 14*a* calculates the average value (intersection passage characteristic value average) γmaxAve of the absolute value of the intersection passage characteristic value (maximum yaw angular velocity) γmax for each intersection based on the intersection travel information received from the plural vehicles C (that is, all the vehicles C) among the intersection travel information extracted in step S203. Specifically, as shown in FIG. 5, first, the intersection standard driving operation level determining unit 14*a* initializes a variable i to 0 (step S301). Subsequently, the intersection standard driving operation level determining unit 14*a* adds 1 to the variable i (step S302). Subsequently, the intersection standard driving operation level determining unit 14*a* selects the intersection travel information including the intersection ID having a numerical value equal to the variable i from among the extracted intersection travel information (step S303). Subsequently, the intersection standard driving operation level determining unit 14*a* sets the average value (intersection passage characteristic value average) γmaxAve of the absolute value of the intersection passage characteristic value γmax included in the selected intersection travel information as an average value of the intersection passage characteristic value of the intersection whose intersection ID is equal to the variable i (step S304). Further, the intersection standard driving operation level determining unit 14*a* repeats the flow (steps S302 to S304) until the variable i becomes equal to or greater than the total number n of the intersections (step S305). Thus, the intersection standard driving operation level determining unit 14*a* calculates the intersection passage characteristic value average γmaxAve with respect to all the intersections.

Figure 6:
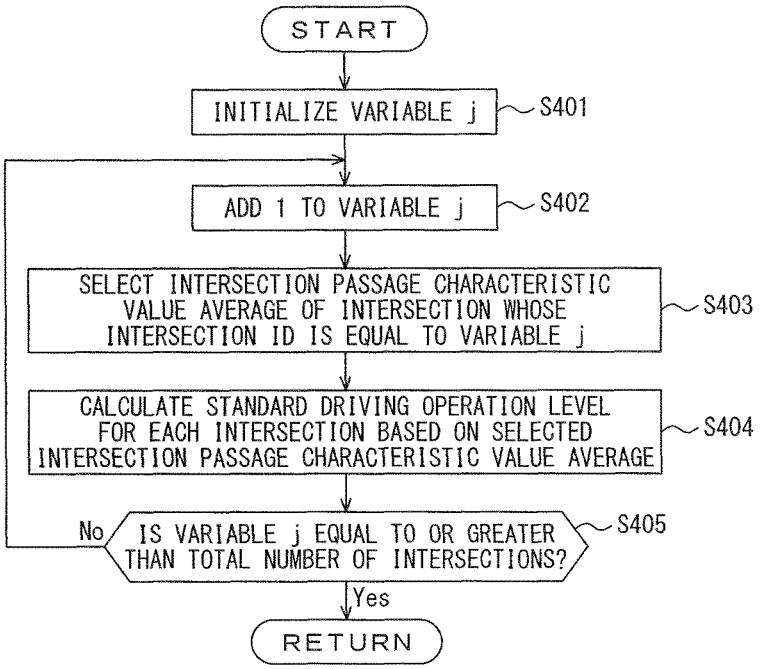
FIG. 6 is a flowchart illustrating details of a process executed in step S205.
Figures 7, 8:
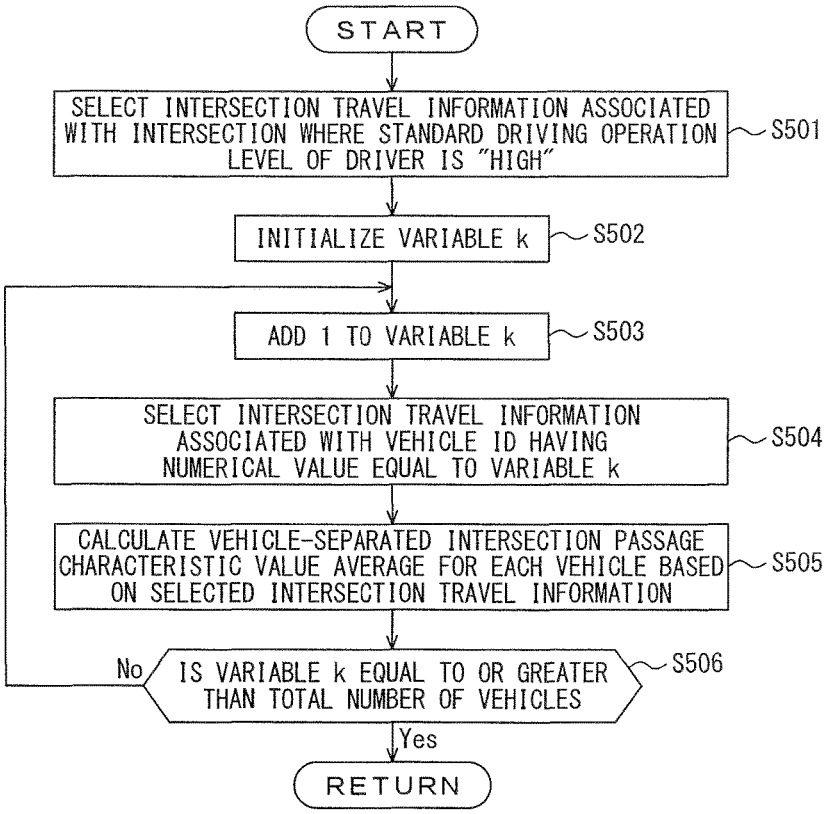
FIG. 7 is a diagram illustrating the relationship between an intersection passage characteristic value average and a standard driving operation level of a driver.
FIG. 8 is a flowchart illustrating details of a process executed in step S206.

FIG. 6 is a flowchart illustrating details of the process executed in step S205. FIG. 7 is a diagram illustrating the relationship between the intersection passage characteristic value average and the standard driving operation level of the driver.

Subsequently, the procedure proceeds to step S205, and then, the intersection standard driving operation level determining unit 14*a* determines the standard driving operation level of the driver when turning to the right or left at the intersection for each intersection based on the intersection passage characteristic value average γmaxAve calculated in step S204. Specifically, the intersection standard driving operation level determining unit 14*a* initializes a variable j to 0, as shown in FIG. 6 (step S401). Subsequently, the intersection standard driving operation level determining unit 14*a* adds 1 to the variable j (step S402). Subsequently, the intersection standard driving operation level determining unit 14*a* selects, from among the calculated intersection passage characteristic value average γmaxAve, the intersection passage characteristic value average γmaxAve corresponding to the intersection whose intersection ID is equal to the variable j (step S403). Subsequently, the intersection standard driving operation level determining unit 14*a* determines the standard driving operation level of the driver when turning to the right or left at the intersection whose intersection ID is equal to the variable j, based on the selected intersection passage characteristic value average γmaxAve.

Specifically, as shown in FIG. 7, if the selected intersection passage characteristic value average γmaxAve is equal to or greater than 0 deg/s and smaller than 20 deg/s, the intersection standard driving operation level determining unit 14*a* determines that the standard driving operation level of the driver when turning to the right or left at the intersection whose intersection ID is equal to the variable j is "low". On the other hand, if the selected intersection passage characteristic value average γmaxAve is equal to or greater than 20 deg/s, the intersection standard driving operation level determining unit 14*a* determines that the standard driving operation level of the driver when turning to the right or left at the intersection whose the intersection ID is equal to the variable j is "high" (step S404). Thus, the intersection standard driving operation level determining unit 14*a* determines that as the intersection passage characteristic value average γmaxAve is larger, the standard driving operation level of the driver when turning to the right or left at the intersection is higher. That is, at the intersection where the radius of curvature of a path when turning to the right or left is small and the visibility is poor, the absolute value of the yaw angular velocity γ becomes a relatively large value. Accordingly, if the intersection passage characteristic value average γmaxAve is a large value, it is determined that the standard driving operation level of the driver when turning to the right or left at the intersection is "high". On the other hand, at the intersection where the radius of curvature of a path when turning to the right or left is large and the visibility is good, the absolute value of the yaw angular velocity γ becomes a relatively small value. Accordingly, if the intersection passage characteristic value average γmaxAve is a small value, it is determined that the standard driving operation level of the driver when turning to the right or left at the intersection is "low". Further, until the variable j becomes equal to or greater than the total number n of the intersections, the intersection standard driving operation level determining unit 14*a* repeats the flow (step S402 to S404) (step S405). Thus, the intersection standard driving operation level determining unit 14*a* determines the standard driving operation level of the driver when turning to the right or left at the intersection with respect to all the intersections.

FIG. 8 is a flowchart illustrating details of the process executed in step S206.

Subsequently, the procedure proceeds to step S206, and then, as shown in FIG. 8, the standard driving operation level-separated driver characteristic determining unit 14*b* selects the intersection travel information associated with the intersection where the standard driving operation level of the driver determined in step S205 is "high", from among the intersection travel information extracted in step S203 (step S501). Subsequently, the standard driving operation level-separated driver characteristic determining unit 14*b* calculates the average value (vehicle-separated intersection passage characteristic value average) VγmaxCAve of the intersection passage characteristic value (yaw angular velocity maximum vehicle velocity) Vγmax for each vehicle C based on the selected intersection travel information. Specifically, the standard driving operation level-separated driver characteristic determining unit 14*b* initializes a variable k to 0 (step S502). Subsequently, the standard driving operation level-separated driver characteristic determining unit 14*b* adds 1 to the variable k (step S503). Subsequently, the standard driving operation level-separated driver characteristic determining unit 14*b* selects the intersection travel information associated with the vehicle ID having a numerical value equal to the variable k from among the intersection travel information selected in step S501 (step S504). Subsequently, the standard driving operation level-separated driver characteristic determining unit 14*b* sets the average value of the intersection passage characteristic value Vγmax included in the selected intersection travel information as the average value (vehicle-separated intersection passage characteristic value average) VγmaxCAve of the intersection passage characteristic value of the vehicle C whose vehicle ID is equal to the variable k (step S505). Further, the standard driving operation level-separated driver characteristic determining unit 14*b* repeats the flow (step S503 to S505) until the variable k becomes equal to or greater than the total number m of the vehicles (step S506). Thus, the standard driving operation level-separated driver characteristic determining unit 14*b* calculates the vehicle-separated intersection passage characteristic value average VγmaxCAve with respect to all the vehicles C.

Figure 9:
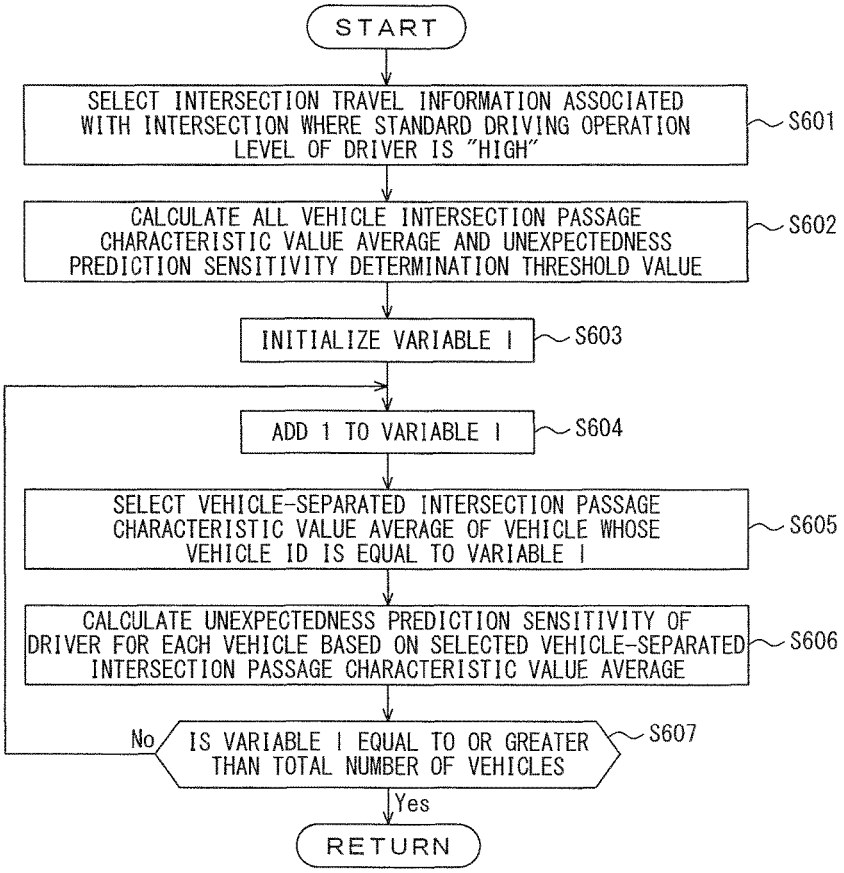
FIG. 9 is a flowchart illustrating details of a process executed in step S207.

FIG. 9 is a flowchart illustrating details of the process executed in step S207.

Subsequently, the procedure proceeds to step S207, and then, the unexpectedness prediction sensitivity determining unit 15 determines the unexpectedness prediction sensitivity of the driver when turning to the right or left at the intersection for each vehicle C based on the intersection travel information extracted in step S203 and the standard driving operation level of the driver determined in step S205. Specifically, as shown in FIG. 9, the unexpectedness prediction sensitivity determining unit 15 selects the intersection travel information associated with the intersection where the standard driving operation level of the driver determined in step S205 is "high" from among the intersection travel information extracted in step S203 (step S601). Subsequently, the unexpectedness prediction sensitivity determining unit 15 calculates an average value (hereinafter, also referred to as an all vehicle intersection passage characteristic value average) Vth of the intersection passage characteristic value Vγmax included in the selected intersection travel information and a standard deviation (hereinafter, referred to as an unexpectedness prediction sensitivity determination threshold value) σth of the intersection passage characteristic value Vγmax (step S602). Subsequently, the unexpectedness prediction sensitivity determining unit 15 determines the unexpectedness prediction sensitivity of the driver when turning to the right or left at the intersection for each vehicle C based on a difference between the calculated all vehicle intersection passage characteristic value average Vth and the vehicle-separated intersection passage characteristic value average VγmaxCAve calculated in step S206. Specifically, first, the unexpectedness prediction sensitivity determining unit 15 initializes a variable 1 to 0 (step S603). Subsequently, the unexpectedness prediction sensitivity determining unit 15 adds 1 to the variable 1 (step S604). Subsequently, the unexpectedness prediction sensitivity determining unit 15 selects the vehicle-separated intersection passage characteristic value average VγmaxCAve of the vehicle C whose vehicle ID is equal to the variable 1 from among the calculated vehicle-separated intersection passage characteristic value average VγmaxCAve (step S605).

Figure 10:
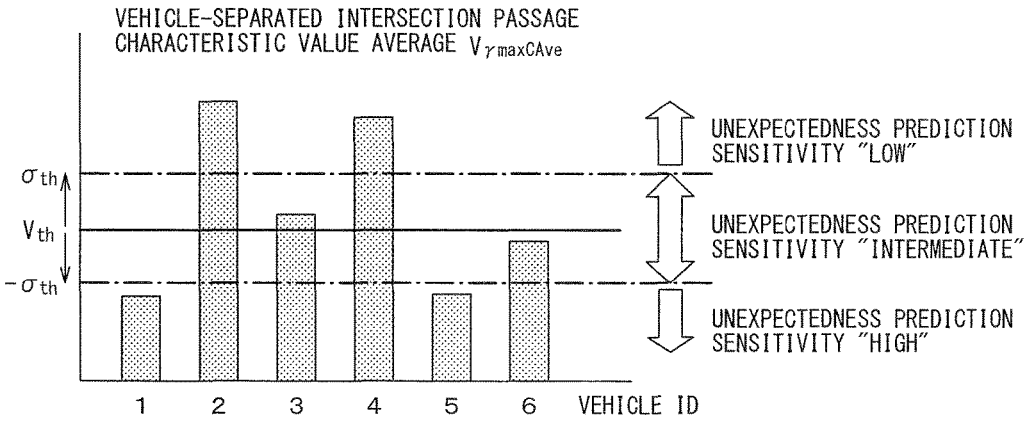
FIG. 10 is a diagram illustrating the relationship between a vehicle-separated intersection passage characteristic value average and an unexpectedness prediction sensitivity.

FIG. 10 is a diagram illustrating the relationship between the vehicle-separated intersection passage characteristic value average and the unexpectedness prediction sensitivity.

Subsequently, the unexpectedness prediction sensitivity determining unit 15 determines the unexpectedness prediction sensitivity of the driver of the vehicle C whose vehicle ID is equal to the variable 1 when turning to the right or left at the intersection based on a subtraction result obtained by subtracting the all vehicle intersection passage characteristic value average Vth from the selected vehicle-separated intersection passage characteristic value average VγmaxCAve (step S606). Specifically, as shown in FIG. 10, if the subtraction result is equal to or greater than the unexpectedness prediction sensitivity determination threshold value σth, the unexpectedness prediction sensitivity determining unit 15 determines that the unexpectedness prediction sensitivity of the driver of the vehicle C whose vehicle ID is equal to the variable 1 when turning to the right or left at the intersection is "low".

On the other hand, if the subtraction result is smaller than the unexpectedness prediction sensitivity determination threshold value σth and is equal to or greater than a sign-inverted threshold value (−σth), the unexpectedness prediction sensitivity determining unit 15 determines that the unexpectedness prediction sensitivity of the driver of the vehicle C whose vehicle ID is equal to the variable 1 when turning to the right or left at the intersection is "intermediate". Here, the sign-inverted threshold value (−σth) represents a numerical value obtained by multiplying the unexpectedness prediction sensitivity determination threshold value σth by "−1". Further, if the subtraction result is smaller than the sign-inverted threshold value (−σth), the unexpectedness prediction sensitivity determining unit 15 determines that the unexpectedness prediction sensitivity of the driver of the vehicle C whose vehicle ID is equal to the variable 1 when turning to the right or left at the intersection is "high" (step S606).

Thus, the unexpectedness prediction sensitivity determining unit 15 determines that as the subtraction result (VγmaxCAve-Vth) is smaller, the unexpectedness prediction sensitivity of the driver when turning to the right or left at the intersection is higher. That is, the vehicle C having a large average value of the yaw angular velocity maximum vehicle velocity Vγmax when turning to the right or left at the intersection has a high possibility of approaching another vehicle or a pedestrian when turning to the right or left at the intersection. Accordingly, if the subtraction result (VγmaxCAve−Vth) is a large value, it is determined that the unexpectedness prediction sensitivity of the driver when turning to the right or left at the intersection is "low". On the other hand, the vehicle C having a small average value of the yaw angular velocity maximum vehicle velocity Vγmax when turning to the right or left at the intersection has a low possibility of approaching another vehicle or a pedestrian when turning to the right or left at the intersection. Accordingly, if the subtraction result (VγmaxCAve−Vth) is a small value, it is determined that the unexpectedness prediction sensitivity of the driver when turning to the right or left at the intersection is "high". Further, the unexpectedness prediction sensitivity determining unit 15 repeats the flow (step S604 to S606) until the variable 1 becomes equal to or greater than the total number m of the vehicles (step S607). Thus, the unexpectedness prediction sensitivity determining unit 15 determines the unexpectedness prediction sensitivity of the driver when turning to the right or left at the intersection with respect to all the vehicles C.

Subsequently, the procedure proceeds to step S208, and then, the unexpectedness prediction sensitivity determining unit 15 transmits the determination result of the unexpectedness prediction sensitivity performed in step S207 to the vehicle C specified by the vehicle ID of the intersection travel information received in step S201 through the base station transmitting unit 16.

In the present embodiment, an example in which the determination result of the unexpectedness prediction sensitivity of the driver when turning to the right or left at the intersection is transmitted to the vehicle C is shown, but a different configuration may be employed. For example, a configuration in which the determination result of the unexpectedness prediction sensitivity of the driver when turning to the right or left at the intersection is used for setting of automobile insurance (for example, setting of grades) may be used. In this case, the determination result of the unexpectedness prediction sensitivity of the driver when turning to the right or left at the intersection may be transmitted to an insurance company or the like that handles automobile insurance through the communication channel 3.

(Operation and Others)

Next, an operation of the unexpectedness prediction sensitivity determination system S will be described.

As shown in FIG. 2A, it is assumed that, during traveling on a road, an intersection appears ahead of the vehicle C (hereinafter, also referred to as a vehicle C1). Further, it is assumed that a driver of the vehicle C1 performs a steering operation and the vehicle C1 thus turns to the right or left at the intersection. Then, the controller 9 of the vehicle C1 records time series data on the yaw angular velocity γ and the vehicle velocity V (steps S101 and S102 in FIG. 3). Subsequently, the controller 9 calculates the intersection passage characteristic values (maximum yaw angular velocity and yaw angular velocity maximum vehicle velocity) γmax and Vγmax based on the recorded time series data on the yaw angular velocity γ and the vehicle velocity V. Subsequently, the controller 9 generates intersection travel information based on the calculated intersection passage characteristic values γmax and Vγmax (step S103 in FIG. 3). Further, the controller 9 transmits the generated intersection travel information to the base station B through the vehicle transmitting unit 11 (step S104 in FIG. 3).

Further, the unexpectedness prediction sensitivity determination apparatus 2 of the base station B receives the intersection travel information output by the controller 9 and records the received intersection travel information (by the base station receiving unit 12 and the intersection travel information recording unit 13 in FIG. 1) (steps S201 and S202 in FIG. 4). Subsequently, the unexpectedness prediction sensitivity determination apparatus 2 calculates the average value (intersection passage characteristic value average) γmaxAve of the absolute value of the intersection passage characteristic value for each intersection based on the intersection travel information received from the plural vehicles C among the intersection travel information recorded in the intersection travel information recording unit 13 (by the intersection standard driving operation level determining unit 14*a* in FIG. 1) (steps S203 and S204 in FIG. 4).

Here, at the intersection where the radius of curvature of the path when turning to the right or left is small (at the intersection where the visibility is poor), generally, there is a tendency that the yaw angular velocity γ when turning to the right or left at the intersection becomes a relatively large value. Accordingly, the maximum yaw angular velocity (intersection passage characteristic value) γmax becomes a relatively large value, and thus, the intersection passage characteristic value average γmaxAve becomes a relatively large value. On the other hand, at the intersection where the radius of curvature of the path when turning to the right or left is large (at the intersection where the visibility is good), generally there is a tendency that the yaw angular velocity γ, when turning to the right or left at the intersection, becomes a relatively small value. Accordingly, the maximum yaw angular velocity (intersection passage characteristic value) γmax becomes a relatively small value, and thus, the intersection passage characteristic value average γmaxAve becomes a relatively small value.

Subsequently, the unexpectedness prediction sensitivity determination apparatus 2 determines the standard driving operation level of the driver when turning to the right or left at the intersection for each intersection based on the calculated intersection passage characteristic value average γmaxAve (by the intersection standard driving operation level determining section 14*a* in FIG. 1) (step S205 in FIG. 4). Here, as shown in FIG. 7, the unexpectedness prediction sensitivity determination apparatus 2 determines that the standard driving operation level of the driver when turning to the right or left at the intersection is "low" at an intersection where the intersection passage characteristic value average γmaxAve satisfies $0 \leq \gamma maxAve < 20$. Further, the unexpectedness prediction sensitivity determination apparatus 2 determines that the standard driving operation level of the driver when turning to the right or left at the intersection is "high" at an intersection where the intersection passage characteristic value average γmaxAve satisfies $20 \leq \gamma maxAve$.

Subsequently, the unexpectedness prediction sensitivity determination apparatus 2 selects the intersection travel information associated with the intersection where the standard driving operation level of the driver is "high". Subsequently, the unexpectedness prediction sensitivity determination apparatus 2 calculates the average value (vehicle-separated intersection passage characteristic value average) VγmaxCAve of the intersection passage characteristic value Vγmax for each vehicle C based on the selected intersection travel information (by the standard driving operation level-separated driver characteristic determining unit 14*b* in FIG. 1) (step S206 in FIG. 4). Thus, since the standard driving operation level of the driver when turning to the right or left at the intersection is changed according to an intersection characteristic such as the visibility of the intersection, even though the driving operation of the driver when turning to the right or left at the intersection is changed and the intersection passage characteristic value Vγmax when turning to the right or left at the intersection varies for each intersection, it is possible to reduce the variation of the intersection passage characteristic value Vγmax used for determination of the unexpectedness prediction sensitivity of the driver.

Subsequently, the unexpectedness prediction sensitivity determination apparatus 2 determines the unexpectedness prediction sensitivity of the driver when turning to the right or left at the intersection for each vehicle C based on the calculated vehicle-separated intersection passage characteristic value average VγmaxCAve (by the unexpectedness prediction sensitivity determining unit 15 in FIG. 1) (step S207 in FIG. 4). Here, as shown in FIG. 10, with respect to the vehicle C in which the subtraction result (VγmaxCAve−Vth) obtained by subtracting the all vehicle intersection passage characteristic value average Vth from the vehicle-separated intersection passage characteristic value average VγmaxCAve satisfies $\sigma th \leq V\gamma maxCAve - Vth$, the unexpectedness prediction sensitivity determination apparatus 2 determines that the unexpectedness prediction sensitivity of the driver when turning to the right or left at the intersection is "low". Further, with respect to the vehicle C in which the subtraction result (VγmaxCAve−Vth) satisfies $-\sigma th \leq V\gamma maxCAve - Vth < \sigma th$, the unexpectedness prediction sensitivity determination apparatus 2 determines that the unexpectedness prediction sensitivity of the driver when turning to the right or left at the intersection is "intermediate". Further, with respect to the vehicle C in which the subtraction result (VγmaxCAve−Vth) satisfies $V\gamma maxCAve - Vth < -\sigma th$, the unexpectedness prediction sensitivity determination apparatus 2 determines that the unexpectedness prediction sensitivity of the driver when turning to the right or left at the intersection is "high".

Subsequently, the unexpectedness prediction sensitivity determination apparatus 2 transmits the determination result of the unexpectedness prediction sensitivity to the vehicle C1 through the base station transmitting unit 16 (by the unexpectedness prediction sensitivity determining unit 15 in FIG. 1) (step S208 in FIG. 4). Further, the controller 9 of the vehicle C1 receives the determination result output by the unexpectedness prediction sensitivity determination apparatus 2 through the vehicle receiving unit 8, and outputs a notification command to the notifying unit 10. Further, the notifying unit 10 notifies the determination result of the unexpectedness prediction sensitivity of the driver when turning to the right or left at the intersection according to the notification command.

As described above, the unexpectedness prediction sensitivity determination apparatus 2 of the present embodiment determines the unexpectedness prediction sensitivity of the driver when turning to the right or left at the intersection based on the intersection travel information associated with the intersection where the standard driving operation level of the driver when turning to the right or left at the intersection is "high", that is, the intersection where the radius of curvature of the path when turning to the right or left is small. Accordingly, in the unexpectedness prediction sensitivity determination apparatus 2 of the present embodiment, it is possible to delete the intersection travel information associated with the intersection where the radius of curvature of the path when turning to the right or left is large from the intersection travel information used for determination of the unexpectedness prediction sensitivity of the driver. Thus, in the unexpectedness prediction sensitivity determination apparatus 2 of the present embodiment, it is possible to suppress the unexpectedness prediction sensitivity of the driver when turning to the right or left at the intersection from being mistakenly determined as "low" even though the frequency of passing the intersection where the radius of curvature of the path when turning to the right or left is large is high.

It is noted that, in the method of determining the unexpectedness prediction sensitivity of the driver when turning to the right or left at the intersection based on the intersection travel information associated with all the intersections regardless of the standard driving operation level of the driver, if the frequency of passing the intersection where the radius of curvature of the path when turning to the right or left is large is high, the vehicle-separated intersection passage characteristic value average VγmaxCAve increases. Accordingly, there is a possibility that the unexpectedness prediction sensitivity of the driver when turning to the right or left at the intersection is mistakenly determined as "low".

In the present embodiment, the intersection passage characteristic values γmax and Vγmax form a travel state amount. Similarly, the base station receiving unit 12 in FIG. 1 and step S201 in FIG. 4 form a receiving unit. Further, the intersection travel information recording unit 13 in FIG. 1 and step S202 in FIG. 4 form an intersection travel information recording unit. Further, the intersection standard driving operation level determining unit 14*a* in FIG. 1 and steps S204 and S205 in FIG. 4 form a standard driving operation level determining unit. Further, the standard driving operation level-separated driver characteristic determining unit 14*b* in FIG. 1, the unexpectedness prediction sensitivity determining unit 15 and steps S206 and S207 in FIG. 4 form an unexpectedness prediction sensitivity determining unit. Further, the vehicle-separated intersection passage characteristic value average VγmaxCAve forms a vehicle-separated travel state average value. Further, the intersection standard driving operation level determining unit 14*a* in FIG. 1 and step S204 in FIG. 4 form an average value calculating unit. Further, the intersection standard driving operation level determining unit 14*a* in FIG. 1 and step S205 in FIG. 4 form a standard driving operation level determination executing unit. Further, the standard driving operation level-separated driver characteristic determining unit 14*b* in FIG. 1 and step S206 in FIG. 4 form a vehicle-separated travel state average value calculating unit. Further, the all vehicle intersection passage characteristic value average Vth forms a plural-vehicle travel state average value. Further, the unexpectedness prediction sensitivity determining unit 15 in FIG. 1 and step S207 in FIG. 4 form a plural-vehicle travel state average value calculating unit and an unexpectedness prediction sensitivity determination executing unit.

(Effects of the Present Embodiment)

The present embodiment shows the following effects.

(1) The unexpectedness prediction sensitivity determination apparatus 2 determines the standard driving operation level of the driver when turning to the right or left at the intersection for each intersection based on the intersection travel information received from the plural vehicles C. Subsequently, the unexpectedness prediction sensitivity determination apparatus 2 determines the unexpectedness prediction sensitivity of the driver when turning to the right or left at the intersection based on the intersection travel information associated with the intersections where the determined standard driving operation levels of the driver are identical to one another.

According to such a configuration, for example, even though the standard driving operation level of the driver when turning to the right or left at the intersection is changed for each intersection according to the visibility of the intersection or the like, the driving operation of the driver when turning to the right or left at the intersection is changed, and the maximum yaw angular velocity γmax included in the intersection travel information when turning to the right or left at the intersection varies for each intersection, it is possible to reduce the variation of the maximum yaw angular velocity γmax used for determination of the unexpectedness prediction sensitivity of the driver. Thus, it is possible to improve determination accuracy of the unexpectedness prediction sensitivity of the driver when turning to the right or left at the intersection.

(2) The unexpectedness prediction sensitivity determination apparatus 2 calculates the average value (intersection passage characteristic value average) γmaxAve of the absolute value of the maximum vehicle velocity γmax for each intersection based on the maximum yaw angular velocity γmax included in the intersection travel information received from the plural vehicles C among the intersection travel information recorded in the intersection travel information recording unit 13. Subsequently, the unexpectedness prediction sensitivity determination apparatus 2 determines that as the calculated average value (intersection passage characteristic value average) γmaxAve of the maximum yaw angular velocity γmax is smaller, the standard driving operation level of the driver is higher.

According to such a configuration, for example, since the standard driving operation level of the driver when turning to the right or left at the intersection is high, when the driver reduces the maximum yaw angular velocity γmax when turning to the right or left at the intersection, it is possible to determine that the standard driving operation level of the driver is high. Thus, it is possible to determine the standard driving operation level of the driver when turning to the right or left at the intersection with high accuracy.

(3) The unexpectedness prediction sensitivity determination apparatus 2 calculates the average value (vehicle-separated intersection passage characteristic value average) VγmaxCAve of the intersection passage characteristic value Vγmax for each vehicle C. Subsequently, the unexpectedness prediction sensitivity determination apparatus 2 calculates the average value (all vehicle intersection passage characteristic value average) Vth of the intersection passage characteristic value Vγmax based on the intersection travel information received from the plural vehicles C. Subsequently, the unexpectedness prediction sensitivity determination apparatus 2 determines the unexpectedness prediction sensitivity of the driver when turning to the right or left at the intersection, as the unexpectedness prediction sensitivity, based on the difference between the vehicle-separated intersection passage characteristic value average VγmaxCAve and the all vehicle intersection passage characteristic value average Vth.

According to such a configuration, for example, when the yaw angular velocity maximum vehicle velocity Vγmax when turning to the right or left at the intersection is large and the difference (VγmaxCAve−Vth) between the vehicle-separated intersection passage characteristic value average VγmaxCAve and the all vehicle intersection passage characteristic value average Vth is large, it is possible to determine that the unexpectedness prediction sensitivity of the driver is "low". Further, when the yaw angular velocity maximum vehicle velocity Vγmax when turning to the right or left at the intersection is small and the difference (VγmaxCAve−Vth) between the vehicle-separated intersection passage characteristic value average VγmaxCAve and the all vehicle intersection passage characteristic value average Vth is small (negative value), it is possible to determine that the unexpectedness prediction sensitivity of the driver is "high". Thus, it is possible to easily determine the unexpectedness prediction sensitivity of the driver when turning to the right or left at the intersection.

(4) The unexpectedness prediction sensitivity determination apparatus 2 determines the unexpectedness prediction sensitivity of the driver when turning to the right or left at the intersection based on the intersection travel information associated with the intersection where the standard driving operation level of the driver when turning to the right or left at the intersection is determined to be at the highest stage "high" among the intersection travel information.

According to such a configuration, the unexpectedness prediction sensitivity determination apparatus 2 determines the unexpectedness prediction sensitivity of the driver when turning to the right or left at the intersection where the possibility of contact with another vehicle is at the highest stage "high". Thus, it is possible to determine the unexpectedness prediction sensitivity of the driver at the intersection where the unexpectedness prediction sensitivity of the driver is relatively important.

Second Embodiment

Next, a second embodiment of the invention will be described with reference to the accompanying drawings.

The same reference numerals are given to the same components as in the above-described embodiment.

The present embodiment is different from the first embodiment in that the yaw angular velocity maximum vehicle velocity Vγmax instead of the maximum yaw angular velocity γmax is employed for determination of the standard driving operation level of the driver when turning to the right or left at the intersection.

Specifically, the present embodiment is different from the first embodiment in processing of steps S204 and S205 in FIG. 4.

In step S204, the intersection standard driving operation level determining unit 14*a* calculates the average value (intersection passage characteristic value average) VγmaxAve of the intersection passage characteristic value Vγmax for each intersection based on the intersection travel information received from the plural vehicles C among the intersection travel information extracted in step S203. Thus, the intersection standard driving operation level determining unit 14*a* calculates the intersection passage characteristic value average VγmaxAve with respect to all the intersections.

Figures 11, 12:
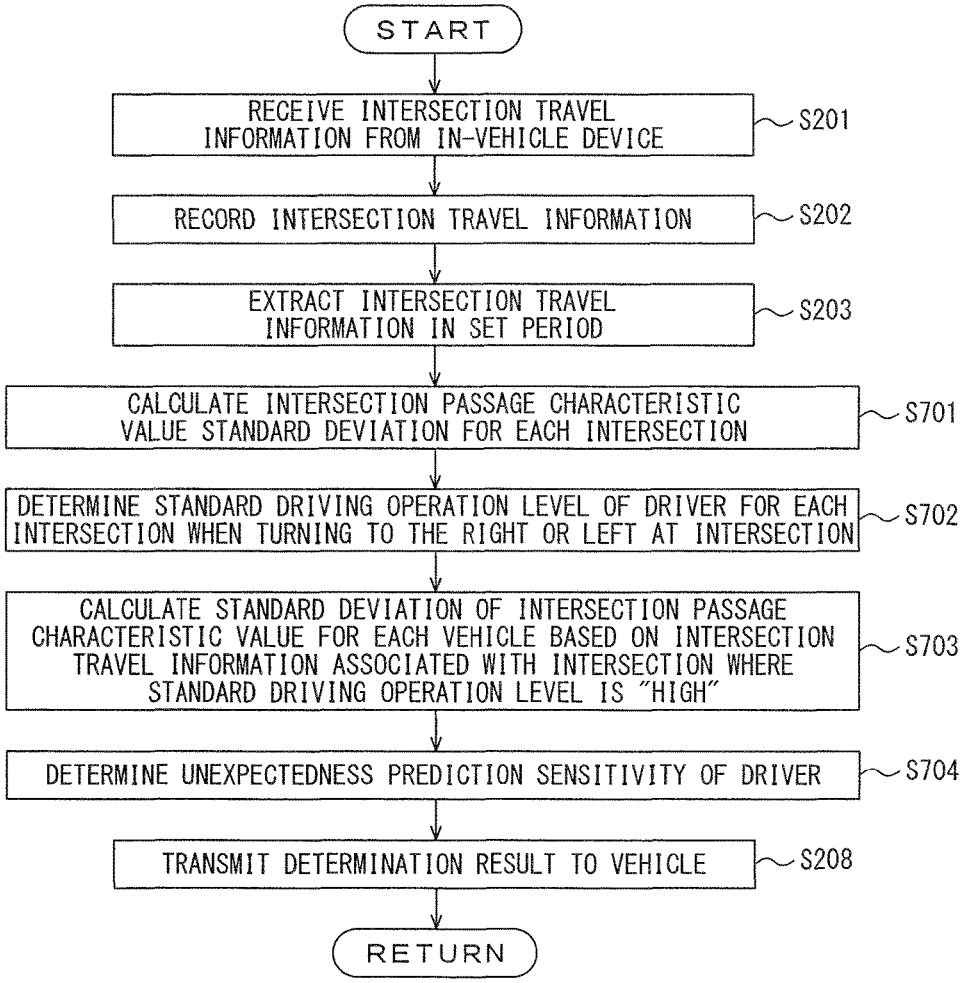
FIG. 11 is a diagram illustrating the relationship between an intersection passage characteristic value average and a standard driving operation level of a driver.
FIG. 12 is a flowchart illustrating an unexpectedness prediction sensitivity determination process.

FIG. 11 is a diagram illustrating the relationship between the intersection passage characteristic value average and the standard driving operation level of the driver.

In step S205, the intersection standard driving operation level determining unit 14*a* determines the standard driving operation level of the driver when turning to the right or left at the intersection for each intersection based on the intersection passage characteristic value average VγmaxAve calculated in step S204. Specifically, as shown in FIG. 6, the intersection standard driving operation level determining unit 14*a* initializes the variable j to 0 (step S401). Subsequently, the intersection standard driving operation level determining unit 14*a* adds 1 to the variable j (step S402). Subsequently, the intersection standard driving operation level determining unit 14*a* selects the intersection passage characteristic value average VγmaxAve corresponding to the intersection whose intersection ID is equal to the variable j from among the calculated intersection passage characteristic value average VγmaxAve (step S403).

Subsequently, the intersection standard driving operation level determining unit 14*a* determines the standard driving operation level of the driver when turning to the right or left at the intersection whose intersection ID is equal to the variable j based on the selected intersection passage characteristic value average VγmaxAve. Specifically, as shown in FIG. 11, if the selected intersection passage characteristic value average VγmaxAve is equal to or greater than 0 km/h and smaller than 30 km/h, the intersection standard driving operation level determining unit 14*a* determines that the standard driving operation level of the driver when turning to the right or left at the intersection whose intersection ID is equal to the variable j is "high". On the other hand, if the selected intersection passage characteristic value average VγmaxAve is equal to or greater than 30 km/h, the intersection standard driving operation level determining unit 14*a* determines that the standard driving operation level of the driver when turning to the right or left at the intersection whose intersection ID is equal to the variable j is "low" (step S404).

Thus, the intersection standard driving operation level determining unit 14*a* determines that as the intersection passage characteristic value average VγmaxAve is smaller, the standard driving operation level of the driver when turning to the right or left at the intersection is higher. That is, at the intersection where a possibility that the vehicle approaches another vehicle or a pedestrian when turning to the right or left is high and the standard driving operation level of the driver when turning to the right or left at the intersection is high, such as an intersection where a possibility that the vehicle approaches an oncoming vehicle that travels straight on the opposite lane when the vehicle turns to the right at the intersection is high, the vehicle velocity V becomes a small value. Accordingly, if the intersection passage characteristic value average VγmaxAve is a small value, it is determined that the standard driving operation level of the driver when turning to the right or left at the intersection is "high".

On the other hand, at the intersection where a possibility that the vehicle approaches another vehicle or a pedestrian when turning to the right or left at the intersection is low and the standard driving operation level of the driver when turning to the right or left at the intersection is high, the vehicle velocity V becomes a large value. Accordingly, if the intersection passage characteristic value average VγmaxAve is a large value, it is determined that the standard driving operation level of the driver when turning to the right or left at the intersection is "low". Further, the intersection standard driving operation level determining unit 14*a* repeats the flow (steps S402 to S404) until the variable j becomes equal to or greater than the total number n of the intersections (step S405). Thus, the intersection standard driving operation level determining unit 14*a* determines the standard driving operation level of the driver when turning to the right or left at the intersection with respect to all the intersections.

In the present embodiment, the intersection standard driving operation level determining unit 14*a* in FIG. 1 and step S204 in FIG. 4 form an average value calculating unit. Similarly, the intersection standard driving operation level determining unit 14*a* in FIG. 1 and step S205 in FIG. 4 form a standard driving operation level determination executing unit.

(Effects of the Present Embodiment)

The present embodiment shows the following effects in addition to the effects of (1) to (4) in the first embodiment.

(1) The unexpectedness prediction sensitivity determination apparatus 2 calculates the average value (yaw angular velocity maximum vehicle velocity average) VγmaxAve of the intersection passage characteristic value Vγmax for each intersection based on the intersection passage characteristic value Vγmax included in the intersection travel information received from the plural vehicles C among the intersection travel information recorded in the intersection travel information recording unit 13. The unexpectedness prediction sensitivity determination apparatus 2 determines that the standard driving operation level of the driver is higher as the average value (yaw angular velocity maximum vehicle velocity average) VγmaxAve of the calculated intersection passage characteristic value Vγmax is higher.

According to such a configuration, for example, since the standard driving operation level of the driver when turning to the right or left at the intersection is high, when the driver reduces the yaw angular velocity maximum vehicle velocity Vγmax, it is possible to determine that the standard driving operation level of the driver is high. Thus, it is possible to determine the standard driving operation level of the driver with high accuracy.

Third Embodiment

Next, a third embodiment of the invention will be described with reference to the accompanying drawings.

The same reference numerals are given to the same components as in the above-described embodiments.

The present embodiment is different from the first and second embodiments in that a statistic indicating a variation degree of the maximum angular velocity γmax is employed for determination of the standard driving operation level of the driver when turning to the right or left at the intersection and a statistic indicating a variation degree of the yaw angular velocity maximum vehicle velocity Vγmax is employed for determination of the unexpectedness prediction sensitivity of the driver. In the present embodiment, the standard deviation is employed as the statistic indicating the variation degree.

Figures 13, 14:
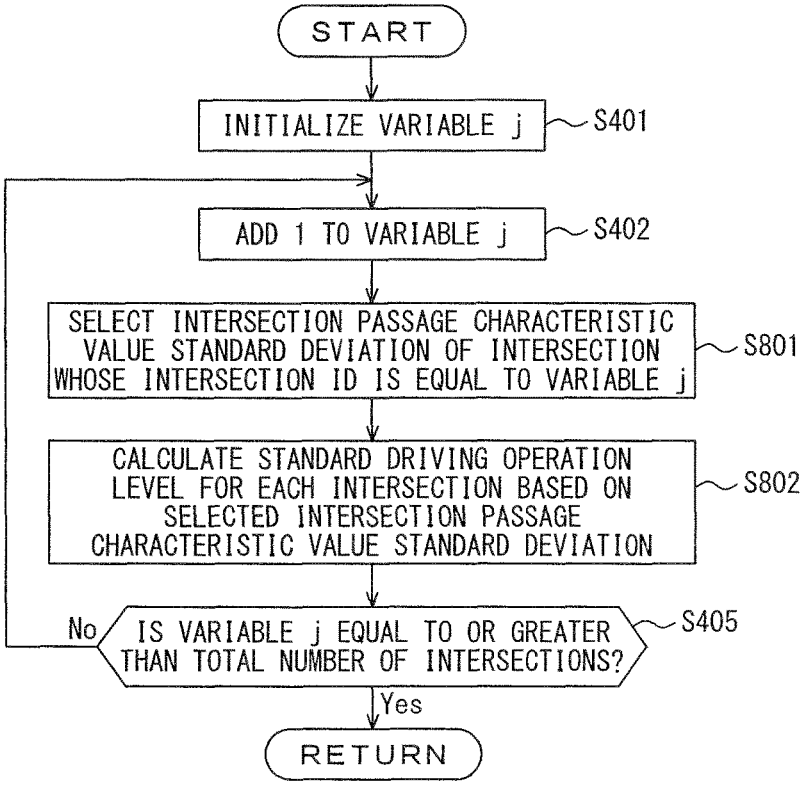
FIG. 13 is a flowchart illustrating details of a process executed in step S702.
FIG. 14 is a diagram illustrating the relationship between an intersection passage characteristic value standard deviation and a standard driving operation level of a driver.

FIG. 12 is a flowchart illustrating an unexpectedness prediction sensitivity determination process. FIG. 13 is a flowchart illustrating details of the process executed in step S205.

Specifically, the present embodiment is different from the first embodiment in that steps S701 to S704 in FIG. 12 are used instead of steps S204 to S207 in FIG. 4 and steps S801 and S802 in FIG. 13 are used instead of steps S403 and S404 in FIG. 6.

In step S701, the intersection standard driving operation level determining unit 14*a* calculates a standard deviation (hereinafter, also referred to as an intersection passage characteristic value standard deviation) γmax of the intersection passage characteristic value γmax for each intersection based on the intersection travel information received from the plural vehicles C among the intersection travel information extracted in step S203. Thus, the intersection standard driving operation level determining unit 14*a* calculates the intersection passage characteristic value standard deviation γmax with respect to all the intersections.

FIG. 14 is a diagram illustrating the relationship between the intersection passage characteristic value standard deviation and the standard driving operation level of the driver.

In step S702, the intersection standard driving operation level determining unit 14*a* determines the standard driving operation level of the driver when turning to the right or left at the intersection for each intersection based on the intersection passage characteristic value standard deviation γmax calculated in step S701. Specifically, as shown in FIG. 13, the intersection standard driving operation level determining unit 14*a* initializes the variable j to 0 (step s401). Subsequently, the intersection standard driving operation level determining unit 14*a* adds 1 to the variable j (step S402). Subsequently, the intersection standard driving operation level determining unit 14*a* selects the intersection passage characteristic value standard deviation γmax corresponding to the intersection whose intersection ID is equal to the variable j from among the calculated intersection passage characteristic value standard deviation γmax (step S801). Subsequently, the intersection standard driving operation level determining unit 14*a* determines the standard driving operation level of the driver when turning to the right or left at the intersection whose intersection ID is equal to the variable j based on the selected intersection passage characteristic value standard deviation γmaxσ.

Specifically, as shown in FIG. 14, if the selected intersection passage characteristic value standard deviation γmax is equal to or greater than 0 deg/s and smaller than γ1 deg/s, the intersection standard driving operation level determining unit 14*a* determines that the standard driving operation level of the driver when turning to the right or left at the intersection whose intersection ID is equal to the variable j is "low". On the other hand, if the selected intersection passage characteristic value standard deviation γmax is equal to or greater than γ1 deg/s and smaller than γ2 (>γ1) deg/s, the intersection standard driving operation level determining unit 14*a* determines that the standard driving operation level of the driver when turning to the right or left at the intersection whose intersection ID is equal to the variable j is "intermediate". Further, if the selected intersection passage characteristic value standard deviation γmax is equal to or greater than γ2 deg/s, the intersection standard driving operation level determining unit 14*a* determines that the standard driving operation level of the driver when turning to the right or left at the intersection whose intersection ID is equal to the variable j is "high" (step S802).

Thus, the intersection standard driving operation level determining unit 14*a* determines that as the intersection passage characteristic value standard deviation γmax is larger, the standard driving operation level of the driver when turning to the right or left at the intersection is higher. That is, at the intersection where road situations are frequently changed, the variation of the maximum yaw angular velocity γmax becomes a large value. Accordingly, if the intersection passage characteristic value standard deviation γmax is a large value, it is determined that the standard driving operation level of the driver when turning to the right or left at the intersection is "high". On the other hand, at the intersection where road situations are not frequently changed, the variation of the maximum yaw angular velocity γmax becomes a small value. Accordingly, if the intersection passage characteristic value standard deviation γmax is a small value, it is determined that the standard driving operation level of the driver when turning to the right or left at the intersection is "low". Further, the intersection standard driving operation level determining unit 14*a* repeats the flow (steps S402, S801 and S802) until the variable j becomes equal to or greater than the total number n of the intersections (step S405). Thus, the intersection standard driving operation level determining unit 14*a* determines the standard driving operation level of the driver when turning to the right or left at the intersection with respect to all the intersections.

In step S703, the standard driving operation level-separated driver characteristic determining unit 14*b* selects intersection travel information associated with the intersection where the standard driving operation level of the driver determined in step S702 is "high", from among the intersection travel information extracted in step S203. Subsequently, the standard driving operation level-separated driver characteristic determining unit 14*b* calculates a standard deviation (hereinafter, also referred to as a vehicle-separated intersection passage characteristic value standard deviation) Vγmaxσ of the intersection passage characteristic value (yaw angular velocity maximum vehicle velocity) Vγmax for each vehicle C based on the selected intersection travel information. Thus, the standard driving operation level-separated driver characteristic determining unit 14*b* calculates the vehicle-separated intersection passage characteristic value standard deviation VγmaxCσ with respect to all the vehicles C.

Figures 15, 16:
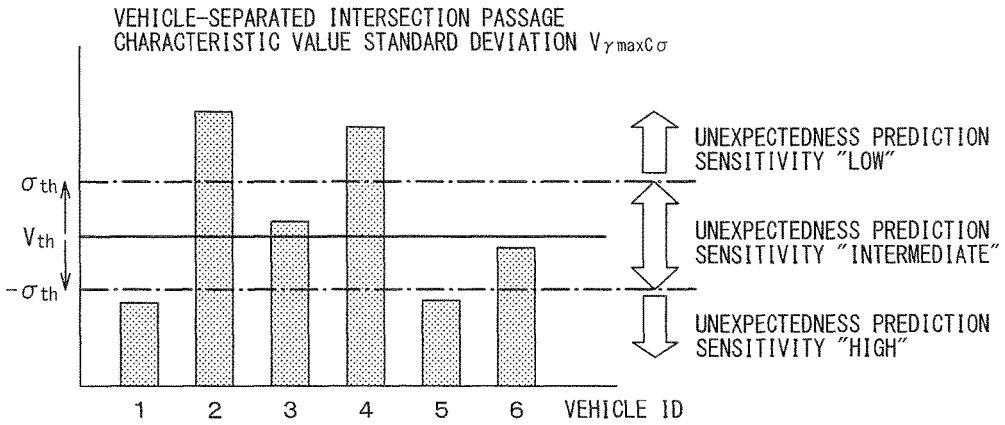
FIG. 15 is a diagram illustrating the relationship between a vehicle-separated intersection passage characteristic value standard deviation and an unexpectedness prediction sensitivity.
FIG. 16 is a diagram illustrating the relationship between an intersection passage characteristic value standard deviation and a standard driving operation level of a driver.
Figure 17A:
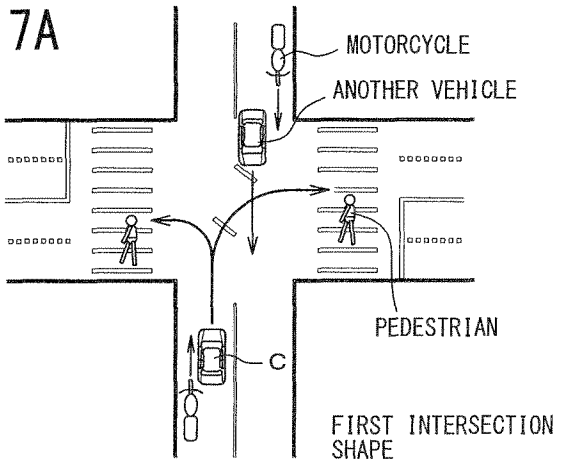
FIGS. 17A to 17D are diagrams illustrating first to fourth intersection shapes, respectively.
Figure 17B:
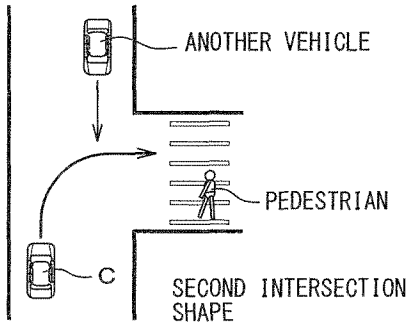
Figure 17C:
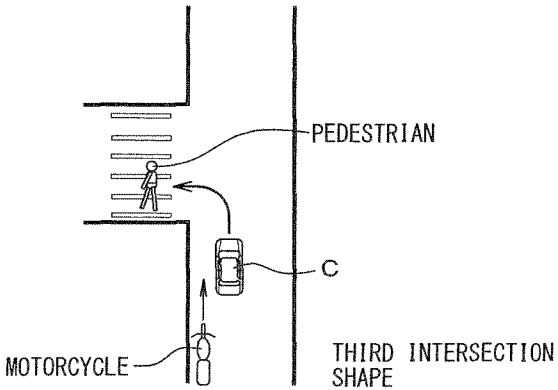
Figure 17D:
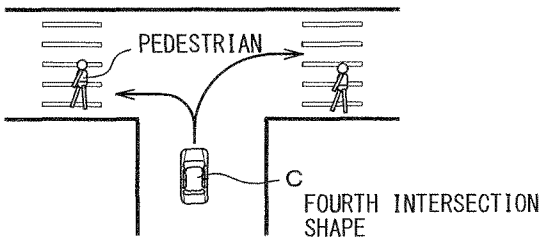

FIG. 15 is a diagram illustrating the relationship between the vehicle-separated intersection passage characteristic value standard deviation and the unexpectedness prediction sensitivity.

In step S704, the unexpectedness prediction sensitivity determining unit 15 determines the unexpectedness prediction sensitivity of the driver when turning to the right or left at the intersection for each vehicle C based on intersection travel information extracted in step S203 and the standard driving operation level of the driver determined in step S702. Specifically, as shown in FIG. 9, the unexpectedness prediction sensitivity determining unit 15 selects intersection travel information associated with the intersection where the standard driving operation level of the driver determined in step S702 is "high" from among the intersection travel information extracted in step S203 (step S601). Subsequently, the unexpectedness prediction sensitivity determining unit 15 calculates a standard deviation (hereinafter, also referred to as an all vehicle intersection passage characteristic value standard deviation) Vth of the intersection passage characteristic value Vγmax included in the selected intersection travel information and the unexpectedness prediction sensitivity determination threshold value σth (for example, 0.2×Vth) (step S602). Subsequently, the unexpectedness prediction sensitivity determining unit 15 determines the unexpectedness prediction sensitivity of the driver when turning to the right or left at the intersection for each vehicle C based on a difference between the calculated all vehicle intersection passage characteristic value standard deviation Vth and the vehicle-separated intersection passage characteristic value standard deviation VγmaxCσ calculated in step S703.

Specifically, the unexpectedness prediction sensitivity determining unit 15 initializes the variable 1 to 0 (step S603). Subsequently, the unexpectedness prediction sensitivity determining unit 15 adds 1 to the variable 1 (step S604). Subsequently, the unexpectedness prediction sensitivity determining unit 15 selects the vehicle-separated intersection passage characteristic value standard deviation VγmaxCσ of the vehicle C whose vehicle ID is equal to the variable 1, from among the calculated vehicle-separated intersection passage characteristic value standard deviation VγmaxCσ (step S605). Subsequently, the unexpectedness prediction sensitivity determining unit 15 determines the unexpectedness prediction sensitivity of the driver of the vehicle C whose vehicle ID is equal to the variable 1 when turning to the right or left at the intersection based on the subtraction result obtained by subtracting the all vehicle intersection passage characteristic value standard deviation Vth from the selected vehicle-separated intersection passage characteristic value standard deviation VγmaxCσ.

Specifically, as shown in FIG. 16, if the subtraction result is equal to or greater than the unexpectedness prediction sensitivity determination threshold value σth, the unexpectedness prediction sensitivity determining unit 15 determines that the unexpectedness prediction sensitivity of the driver of the vehicle C whose vehicle ID is equal to the variable 1 when turning to the right or left at the intersection is "low". On the other hand, if the subtraction result is smaller than the unexpectedness prediction sensitivity determination threshold value σth and is equal to or greater than the sign-inverted threshold value (−σth), the unexpectedness prediction sensitivity determining unit 15 determines that the unexpectedness prediction sensitivity of the driver of the vehicle C whose vehicle ID is equal to the variable 1 when turning to the right or left at the intersection is "intermediate". Here, the sign-inverted threshold value (−σth) represents a numerical value obtained by multiplying the unexpectedness prediction sensitivity determination threshold value σth by "−1". Further, if the subtraction result is smaller than the sign-inverted threshold value (−σth), the unexpectedness prediction sensitivity determining unit 15 determines that the unexpectedness prediction sensitivity of the driver of the vehicle C whose vehicle ID is equal to the variable 1 when turning to the right or left at the intersection is "high" (step S606).

Thus, the unexpectedness prediction sensitivity determining unit 15 determines that as the subtraction result (VγmaxCσ−Vth) is smaller, the unexpectedness prediction sensitivity of the driver when turning to the right or left at the intersection is higher. That is, with respect to the vehicle C having a large variation of the yaw angular velocity maximum vehicle velocity Vγmax when turning to the right or left at the intersection, it is possible to determine that the driver's skill is low. Accordingly, if the subtraction result (VγmaxCσ−Vth) is a large value, it is determined that the unexpectedness prediction sensitivity of the driver when turning to the right or left at the intersection is "low". On the other hand, with respect to the vehicle C having a small variation of the yaw angular velocity maximum vehicle velocity Vγmax when turning to the right or left at the intersection, it is possible to determine that the driver's skill is high. Accordingly, if the subtraction result (VγmaxCσ−Vth) is a small value, it is determined that the unexpectedness prediction sensitivity of the driver when turning to the right or left at the intersection is "high". Further, the unexpectedness prediction sensitivity determining unit 15 repeats the flow (step S604 to S606) until the variable 1 becomes equal to or greater than the total number m of the vehicles (step S607). Thus, the unexpectedness prediction sensitivity determining unit 15 determines the unexpectedness prediction sensitivity of the driver when turning to the right or left at the intersection with respect to all the vehicles C.

In the present embodiment, the vehicle-separated intersection passage characteristic value standard deviation VγmaxCσforms a vehicle-separated statistic. Similarly, the standard driving operation level-separated driver characteristic determining unit 14*b* in FIG. 1 and step S703 in FIG. 12 form a vehicle-separated statistic calculating unit. Further, the all vehicle intersection passage characteristic value standard deviation Vth forms a plural-vehicle statistic. Further, the unexpectedness prediction sensitivity determining unit 15 in FIG. 1 and step S704 in FIG. 12 form a plural-vehicle statistic calculating unit and an unexpectedness prediction sensitivity determination executing unit.

(Effects of the Present Embodiment)

The present embodiment shows the following effects in addition to the effects of (1) to (4) in the first embodiment.

(1) The unexpectedness prediction sensitivity determination apparatus 2 calculates the standard deviation (vehicle-separated intersection passage characteristic value standard deviation) VγmaxCσ of the intersection passage characteristic value Vγmax for each vehicle C. Further, the unexpectedness prediction sensitivity determination apparatus 2 calculates the standard deviation (all vehicle intersection passage characteristic value standard deviation) Vth of the intersection passage characteristic value Vγmax based on the intersection travel information received from the plural vehicles C. Subsequently, the unexpectedness prediction sensitivity determination apparatus 2 determines the unexpectedness prediction sensitivity of the driver when turning to the right or left at the intersection based on the difference between the vehicle-separated intersection passage characteristic value standard deviation VγmaxCσ and the all vehicle intersection passage characteristic value standard deviation Vth.

According to such a configuration, for example, when the variation of the yaw angular velocity maximum vehicle velocity Vγmax when turning to the right or left at the intersection is large and the difference (VγmaxCσ−Vth) between the vehicle-separated intersection passage characteristic value standard deviation VγmaxCσ and the all vehicle intersection passage characteristic value standard deviation Vth is large, it is possible to determine that the unexpectedness prediction sensitivity of the driver is "low". Thus, when the variation of the yaw angular velocity maximum vehicle velocity Vγmax when turning to the right or left at the intersection is small and the difference (VγmaxCσ−Vth) between the vehicle-separated intersection passage characteristic value standard deviation VγmaxCσ and the all vehicle intersection passage characteristic value standard deviation Vth is small (negative value), it is possible to determine that the unexpectedness prediction sensitivity of the driver is "high". Thus, it is possible to easily determine the unexpectedness prediction sensitivity of the driver when turning to the right or left at the intersection.

Modification Example

In the third embodiment, an example in which the maximum yaw angular velocity γmax is employed for determination of the standard driving operation level of the driver when turning to the right or left at the intersection is shown, but a different configuration may be employed. For example, the yaw angular velocity maximum vehicle velocity Vγmax may be employed for determination of the standard driving operation level of the driver when turning to the right or left at the intersection.

Fourth Embodiment

Next, a fourth embodiment of the invention will be described with reference to the accompanying drawings.

The same reference numerals are given to the same components as in the above-described embodiments.

The present embodiment is different from the first to third embodiments in that in addition to the intersection where the intersection passage characteristic values γmax and Vγmax are obtained, an intersection shape when the intersection is seen from a direction where the vehicle C enters the intersection is associated in the intersection travel information. Further, the present embodiment is different from the first to third embodiments in that the intersection travel information is classified according to the intersection shape for each intersection, and the standard driving operation level of the driver when turning to the right or left at the intersection is determined based on the intersection travel information classified according to the intersection shape.

Specifically, the present embodiment is different from the first embodiment in processing of step S103 in FIG. 3 and steps S204 and S205 in FIG. 4.

FIGS. 17A to 17D are diagrams illustrating first to fourth intersection shapes.

In step S103, the controller 9 calculates the intersection passage characteristic values (maximum yaw angular velocity and yaw angular velocity maximum vehicle velocity) γmax and Vγmax based on the time series data on the yaw angular velocity γ and the time series data on the vehicle velocity V recorded in step S102. Subsequently, the controller 9 determines the intersection shape when the intersection is seen from the direction where the vehicle C enters the target intersection. As the intersection shape, the first to fourth shapes are employed. As shown in FIGS. 17A to 17D, the first intersection shape is a crossroad where the vehicle C can turn to the right and left and can travel straight. The second intersection shape is a T-shaped road where the vehicle C can turn to the right and can travel straight. The third intersection shape is a T-shaped road where the vehicle C can turn to the left and can travel straight. The fourth intersection shape is a T-shaped road where the vehicle C can turn to the right and left. Subsequently, the controller 9 generates intersection travel information including the calculated intersection passage characteristic values γmax and Vγmax, an intersection shape ID indicating the intersection shape, the intersection ID of the target intersection and the vehicle ID of the vehicle C. The intersection shape ID refers to unique information set for each intersection shape, which can uniquely specify the intersection shape. Thus, in addition to the intersection where the intersection passage characteristic values are obtained and the vehicle C, the intersection shape when the intersection is seen from the direction where the vehicle C enters the intersection is associated with the intersection travel information.

On the other hand, in step S204, the intersection standard driving operation level determining unit 14*a* calculates the intersection passage characteristic value average γmaxAve for each intersection shape and for each intersection based on the intersection travel information received from the plural vehicles C among the intersection travel information extracted in step S203. Specifically, as shown in FIG. 5, first, the intersection standard driving operation level determining unit 14*a* initializes a variable i to 0 (step S301). Subsequently, the intersection standard driving operation level determining unit 14*a* adds 1 to the variable i (step S302). Subsequently, the intersection standard driving operation level determining unit 14*a* selects the intersection travel information including the intersection ID having a numerical value equal to the variable i from among the extracted intersection travel information (step S303). Subsequently, the intersection standard driving operation level determining unit 14*a* classifies the selected intersection travel information according to the intersection shape. Subsequently, the intersection standard driving operation level determining unit 14*a* calculates the average value (intersection shape-separated intersection passage characteristic value average) γmaxAve of the absolute value of the intersection passage characteristic value γmax included in the intersection travel information for each intersection shape, based on the intersection travel information classified according to the intersection shape (step S304). Further, the intersection standard driving operation level determining section 14*a* repeats the flow (steps S302 to S304) until the variable i becomes equal to or greater than the total number n of the intersections (step S305). Thus, the intersection standard driving operation level determining unit 14*a* calculates the intersection shape-separated intersection passage characteristic value average γmaxAve with respect to all the intersections.

In step S205, and then, the intersection standard driving operation level determining unit 14*a* determines the standard driving operation level of the driver when turning to the right or left at the intersection for each intersection shape and for each intersection, based on the intersection shape-separated intersection passage characteristic value average γmaxAve calculated in step S204. Specifically, the intersection standard driving operation level determining unit 14*a* initializes a variable j to 0, as shown in FIG. 6 (step S401). Subsequently, the intersection standard driving operation level determining unit 14*a* adds 1 to the variable j (step S402). Subsequently, the intersection standard driving operation level determining unit 14*a* selects, from among the calculated intersection shape-separated intersection passage characteristic value average γmaxAve, the intersection shape-separated intersection passage characteristic value average γmaxAve corresponding to the intersection whose intersection ID is equal to the variable j (step S403). Subsequently, the intersection standard driving operation level determining unit 14*a* classifies the selected intersection shape-separated intersection passage characteristic value average γmaxAve according to the intersection shape. Subsequently, the intersection standard driving operation level determining unit 14*a* determines the standard driving operation level of the driver when turning to the right or left at the intersection whose intersection ID is equal to the variable j, in consideration of the intersection shape, for each intersection shape, based on the intersection shape-separated intersection passage characteristic value average γmaxAve.

Specifically, if the intersection shape is the first intersection shape, the intersection standard driving operation level determining unit 14*a* determines that the standard driving operation level of the driver when turning to the right or left at the intersection (hereinafter, also referred to as a shape standard driving operation level) is "high". Further, if the intersection shape is the second intersection shape or the third intersection shape, the intersection standard driving operation level determining unit 14*a* determines that the standard driving operation level of the driver when turning to the right or left at the intersection (shape standard driving operation level) is "intermediate". Further, if the intersection shape is the fourth intersection shape, the intersection standard driving operation level determining unit 14*a* determines that the standard driving operation level of the driver when turning to the right or left at the intersection (shape standard driving operation level) is "low".

That is, as shown in FIGS. 17A to 17D, when turning to the right at the intersection, in the first intersection shape and the second intersection shape, there is a possibility that the vehicle C approaches an oncoming vehicle or a motorcycle that travels straight on the opposite lane, and a possibility that the vehicle C approaches a pedestrian. Further, in the fourth intersection shape, there is a possibility that the vehicle C approaches a pedestrian, whereas there is not a possibility that the vehicle C approaches an oncoming vehicle or a motorcycle that travels straight on the opposite lane. Accordingly, when turning to the right at the intersection, the standard driving operation level of the driver becomes higher in the order of the first and second intersection shapes > the fourth intersection shape. On the other hand, when turning to the left at the intersection, in the first intersection shape and the third intersection shape, there is a possibility that the vehicle C approaches an oncoming vehicle that travels straight on the opposite lane, a possibility that the vehicle C approaches a motorcycle that travels on the left side of the vehicle C, and a possibility that the vehicle C approaches a pedestrian. Further, in the fourth intersection shape, there is a possibility that the vehicle C approaches a pedestrian, whereas there is not a possibility that the vehicle C approaches an oncoming vehicle that travels straight on the opposite lane or a motorcycle. Accordingly, when turning to the left at the intersection, the standard driving operation level of the driver becomes higher in the order of the first and third intersection shapes > the fourth intersection shape. Accordingly, in consideration of both of the turning to the right and left at the intersection, the standard driving operation level of the driver when turning to the right or left at the intersection becomes higher in the order of the first intersection shape > the second and third intersection shapes > the fourth intersection shape.

Further, as shown in FIG. 7, if the intersection shape-separated intersection passage characteristic value average γmaxAve is equal to or greater than 0 deg/s and smaller than 20 deg/s, the intersection standard driving operation level determining unit 14*a* determines that the standard driving operation level of the driver when turning to the right or left at the intersection (hereinafter, also referred to as a traffic state standard driving operation level) is "low". On the other hand, if the intersection shape-separated intersection passage characteristic value average γmaxAve is equal to or greater than 20 deg/s, the intersection standard driving operation level determining unit 14*a* determines that the standard driving operation level of the driver when turning to the right or left at the intersection (traffic state standard driving operation level) is "high".

Further, the intersection standard driving operation level determining unit 14*a* determines the standard driving operation level for each intersection shape when turning to the right or left at the intersection whose intersection ID is equal to the variable j based on a combination of the determination result of the shape standard driving operation level and the determination result of the traffic state standard driving operation level (step S404). Specifically, the intersection standard driving operation level determining unit 14*a* determines that the standard driving operation level of the driver when turning to the right or left at the intersection is higher in the order of the combinations of the shape standard driving operation level "high" and the traffic state standard driving operation level "high" > "high" and "low" > "intermediate" and "high" > "intermediate" and "low" > "low" and "high" > "low" and "low", respectively. Further, until the variable j becomes equal to or greater than the total number n of the intersections, the intersection standard driving operation level determining unit 14*a* repeats the flow (step S402 to S404) (step S405). Thus, the intersection standard driving operation level determining unit 14*a* determines the standard driving operation level of the driver according to the intersection shape with respect to all the intersections.

In the present embodiment, the controller 9 in FIG. 1 and step S204 in FIG. 4 form an intersection travel information classifying or dividing unit. Similarly, the controller 9 in FIG. 1 and step S205 in FIG. 4 form a standard driving operation level determination executing unit.

(Effects of the Present Embodiment)

The present embodiment shows the following effects in addition to the effects of (1) to (4) in the first embodiment.

(1) The unexpectedness prediction sensitivity determination apparatus 2 classifies the intersection travel information according to the intersection shape for each intersection. Subsequently, the unexpectedness prediction sensitivity determination apparatus 2 determines the standard driving operation level of the driver when turning to the right or left at the intersection in consideration of the intersection shape based on the intersection travel information classified according to the intersection shape.

According to such a configuration, for example, for the intersection shape where the standard driving operation level of the driver when turning to the right or left at the intersection is high, it is possible to determine that the standard driving operation level of the driver is high. Thus, it is possible to determine the standard driving operation level of the driver when turning to the right or left at the intersection with high accuracy.

Modification Examples

In the above-described first to fourth embodiments, an example of the combination of the determination method of the standard driving operation level of the driver when turning to the right or left at the intersection and the determination method of the unexpectedness prediction sensitivity of the driver when turning to the right or left at the intersection is shown, but a different combination may be used. For example, a combination configuration of the determination method of the standard driving operation level of the driver when turning to the right or left at the intersection and the determination method of the unexpectedness prediction sensitivity of the driver when turning to the right or left at the intersection, described in the different embodiments, may be used.

Hereinbefore, the invention is described with reference to a limited number of embodiments, but the scope of the invention is not limited thereto, and modifications of the respective embodiments based on the above description will be obvious to those skilled in the art.

The invention claimed is:

1. An unexpectedness prediction sensitivity determination apparatus comprising:

a plurality of in-vehicle devices each mounted on a respective vehicle of a plurality of vehicles and configured to detect approaching an intersection by the respective vehicle;

a base station including:

a receiving unit configured to receive, from some in-vehicle devices of the plurality of in-vehicle devices in response to each of the some in-vehicle devices detecting the intersection and the respective vehicle turning right or left, for a plurality of intersections, intersection travel information that includes a travel state amount indicating a travel state of the respective vehicle when turning to the right or left at the intersection and associates the travel state amount with the intersection where the travel state amount is obtained;

an intersection travel information recording unit configured to record the intersection travel information received by the receiving unit;

a standard driving operation level determining unit configured to determine, for each of the intersections, a standard driving operation level of a standard driver when turning to the right or left at each of the intersections based on plural-vehicle intersection travel information, wherein plural-vehicle intersection travel information comprises the intersection travel information received from the plurality of vehicles among the intersection travel information recorded in the intersection travel information recording unit;

an unexpectedness prediction sensitivity determining unit configured to determine an unexpectedness prediction sensitivity of a driver when turning to the right or left at the intersection based on associated intersection travel information that is the intersection travel information associated with the intersections where the standard driving operation levels determined by the standard driving operation level determining unit are identical to one another, among the intersection travel information recorded in the intersection travel information recording unit; and a transmitting unit configured to transmit the unexpectedness prediction sensitivity to an in-vehicle device mounted in a vehicle driven by the driver, wherein each of the plurality of in-vehicle devices includes:

a vehicle receiving unit configured to receive the unexpectedness prediction sensitivity; and a notifying unit configured to notify the driver of the unexpectedness prediction sensitivity as compared to the standard driver.

2. The unexpectedness prediction sensitivity determination apparatus according to claim 1, wherein the intersection travel information includes one of a maximum yaw angular velocity or a maximum transverse acceleration when turning to the right or left at the intersection, and wherein the standard driving operation level determining unit includes:

an average value calculating unit configured to calculate an average value of an absolute value of the maximum yaw angular velocity for each of the intersections based on the one of the maximum yaw angular velocity or the maximum transverse acceleration included in the plural-vehicle intersection travel information, and a standard driving operation level determination executing unit configured to determine that as the average value calculated by the average value calculating unit is smaller, the standard driving operation level is higher.

3. The unexpectedness prediction sensitivity determination apparatus according to claim 1, wherein the intersection travel information includes one of a yaw angular velocity maximum vehicle velocity that is a vehicle velocity when a yaw angular velocity reaches a maximum value when turning to the right or left at the intersection, or a transverse acceleration maximum vehicle velocity that is a vehicle velocity when a transverse acceleration reaches a maximum value when turning to the right or left at the intersection, and wherein the standard driving operation level determining unit includes:

an average value calculating unit configured to calculate an average value of the yaw angular velocity maximum vehicle velocity for each of the intersections based on the one of the yaw angular velocity maximum vehicle velocity or the transverse acceleration maximum vehicle velocity included in the plural-vehicle intersection travel information, and a standard driving operation level determination executing unit configured to determine that as the average value calculated by the average value calculating unit is larger, the standard driving operation level is higher.

4. The unexpectedness prediction sensitivity determination apparatus according to claim 1, wherein, in addition to the intersection where the travel state amount is obtained, an intersection shape when the intersection is seen from a direction where the vehicle enters the intersection is associated with the intersection travel information, and wherein the standard driving operation level determining unit includes:

an intersection travel information classifying unit configured to classify the intersection travel information included in the plural-vehicle intersection travel information according to the intersection shape for each of the intersections based on the plural-vehicle intersection travel information, and a standard driving operation level determination executing unit configured to determine the standard driving operation level based on the intersection shape based on the intersection travel information classified by the intersection travel information classifying unit according to the intersection shape.

5. The unexpectedness prediction sensitivity determination apparatus according to claim 1, wherein the unexpectedness prediction sensitivity determining unit includes:

a vehicle-separated travel state average value calculating unit configured to calculate a vehicle-separated travel state average value that is an average value of the travel state amount for each of the plurality of vehicles based on the associated intersection travel information, a plural-vehicle travel state average value calculating unit configured to calculate a plural-vehicle travel state average value that is an average value of the travel state amounts based on the intersection travel information received from the plurality of vehicles among the associated intersection travel information, and an unexpectedness prediction sensitivity determination executing unit configured to determine the unexpectedness prediction sensitivity of the driver when turning to the right or left at the intersection based on a difference between the vehicle-separated travel state average value calculated by the vehicle-separated travel state average value calculating unit and the plural-vehicle travel state average value calculated by the plural-vehicle travel state average value calculating unit.

6. The unexpectedness prediction sensitivity determination apparatus according to claim 1, wherein the unexpectedness prediction sensitivity determining unit includes:

a vehicle-separate statistic calculating unit configured to calculate a vehicle-separate statistic that is a statistic indicating a variation degree of the travel state amount for each of the plurality of vehicles based on the associated intersection travel information, a plural-vehicle statistic calculating unit configured to calculate a plural-vehicle statistic that is a statistic indicating a variation degree of the travel state amounts based on the intersection travel information received from the plurality of vehicles among the associated intersection travel information, and an unexpectedness prediction sensitivity determination executing unit configured to determine the unexpectedness prediction sensitivity of the driver when turning to the right or left at the intersection based on a difference between the vehicle-separate statistic calculated by the vehicle-separate statistic calculating unit and the plural-vehicle statistic calculated by the plural-vehicle statistic calculating unit.

7. The unexpectedness prediction sensitivity determination apparatus according to claim 1, wherein the unexpectedness prediction sensitivity determining unit is configured to determine the unexpectedness prediction sensitivity of the driver when turning to the right or left at the intersection based on the associated intersection travel information that is associated with the intersection where the standard driving operation level is determined to be at a highest stage by the standard driving operation level determining unit, among the intersection travel information recorded in the intersection travel information recording unit.

8. The unexpectedness prediction sensitivity determination apparatus of claim 1, wherein the unexpectedness prediction sensitivity notified by the notifying unit to the driver occurs when the driver is turning to the right or left at the intersection and indicates a possibility that the vehicle is approaching another vehicle or a pedestrian when turning to the right or left at the intersection.

9. The unexpectedness prediction sensitivity determination apparatus of claim 8, wherein the driver receives the unexpectedness prediction sensitivity when turning to the right or left at the intersection to steer clear of the other vehicle or the pedestrian.

10. The unexpectedness prediction sensitivity determination apparatus of claim 1, wherein the transmitting unit is further configured to transmit the unexpectedness prediction sensitivity of the driver when turning to the right or left at the intersection to a third party, the third party using the unexpectedness prediction sensitivity to rate the driver.

11. The unexpectedness prediction sensitivity determination apparatus of claim 10, wherein the third party is an automobile insurance provider.

12. An unexpectedness prediction sensitivity determination apparatus comprising a base station and a plurality of in-vehicle devices each mounted on a respective vehicle, the base station including:

a receiving means for receiving, from the plurality of in-vehicle devices mounted in each vehicle for a plurality of intersections, intersection travel information that includes a travel state amount indicating a travel state of the vehicle when turning to the right or left at an intersection and associates the travel state amount with the intersection where the travel state amount is obtained;

an intersection travel information recording means for recording the intersection travel information received by the receiving means;

a standard driving operation level determining means for determining, for each of the plurality of intersections, a standard driving operation level of a driver when turning to the right or left at the each of the plurality of intersections based on plural-vehicle intersection travel information that is the intersection travel information received from the plurality of vehicles among the intersection travel information recorded by the intersection travel information recording means;

an unexpectedness prediction sensitivity determining means for determining an unexpectedness prediction sensitivity of the driver when turning to the right or left at the intersection based on associated intersection travel information that is the intersection travel information associated with the intersections where the standard driving operation levels determined by the standard driving operation level determining means are identical to one another, among the intersection travel information recorded by the intersection travel information recording means; and a transmitting unit means for transmitting the unexpectedness prediction sensitivity to an in-vehicle device out of the plurality of in-vehicle devices mounted on a vehicle driven by the driver, wherein each of the plurality of in-vehicle devices includes:

a vehicle receiving means configured to receive the unexpectedness prediction sensitivity; and a notifying means configured to notify the driver of the unexpectedness prediction sensitivity.

13. An unexpectedness prediction sensitivity determination method comprising:

Receiving, by a receiving unit at a base station, from an in-vehicle device mounted in each of a plurality of vehicles for a plurality of intersections, intersection travel information that includes a travel state amount indicating a travel state of the vehicle when turning to the right or left at an intersection and associates the travel state amount with the intersection where the travel state amount is obtained;

recording the received intersection travel information in an intersection travel information recording unit in the base station;

determining by the base station, for each of intersections, a standard driving operation level of a driver when turning to the right or left at the each of intersections based on plural-vehicle intersection travel information that is the intersection travel information received from the plurality of vehicles among the intersection travel information recorded in the intersection travel information recording unit;

determining be the base station an unexpectedness prediction sensitivity of the driver when turning to the right or left at the intersection based on associated intersection travel information that is the intersection travel information associated with the intersections where the standard driving operation levels are identical to one another, among the intersection travel information recorded in the intersection travel information recording unit;

transmitting by a transmitting unit the unexpectedness prediction sensitivity from the base station to the in-vehicle device;

receiving, by a vehicle receiving unit of the in-vehicle device, the unexpectedness prediction sensitivity; and notifying, by a notifying unit of the in-vehicle device, the driver of the unexpectedness prediction sensitivity.

* * * * *